US012612913B2

(12) United States Patent
Mikami et al.

(10) Patent No.: US 12,612,913 B2
(45) Date of Patent: Apr. 28, 2026

(54) LIQUID PUMP DEVICE

(71) Applicant: MIKUNI CORPORATION, Tokyo (JP)

(72) Inventors: Yuichi Mikami, Iwate (JP); Takeshi Ogi, Iwate (JP); Jun Takahashi, Iwate (JP)

(73) Assignee: MIKUNI CORPORATION, Tokyo (JP)

( * ) Notice: Subject to any disclaimer, the term of this patent is extended or adjusted under 35 U.S.C. 154(b) by 0 days.

(21) Appl. No.: 18/793,932

(22) Filed: Aug. 4, 2024

(65) Prior Publication Data

US 2024/0392782 A1 Nov. 28, 2024

Related U.S. Application Data

(63) Continuation of application No. 17/890,226, filed on Aug. 17, 2022, now abandoned.

(30) Foreign Application Priority Data

Aug. 28, 2021 (JP) ..... 2021-139479
May 26, 2022 (JP) ..... 2022-085748

(51) Int. Cl.
*F04C 14/28* (2006.01)
*F04C 2/10* (2006.01)

(52) U.S. Cl.
CPC ..... *F04C 14/28* (2013.01); *F04C 2/10* (2013.01)

(58) Field of Classification Search
CPC .. F04C 2240/81; F04C 2270/19; F04C 14/28; F04C 2/10; G01D 11/24; G01D 11/245
USPC ..... 374/208, 148, 141, 144, 100, 163, 179
See application file for complete search history.

(56) References Cited

U.S. PATENT DOCUMENTS 3,844,920 A * 10/1974 Burgett ..... G01N 27/4077 60/276
3,960,693 A * 6/1976 Weyl ..... G01N 27/4078 204/428
4,061,117 A * 12/1977 Ikeura ..... F02D 41/1494 123/681
4,184,934 A * 1/1980 Bode ..... G01N 27/4077 73/23.31
4,265,603 A * 5/1981 Chiyoda ..... F04C 23/00 418/2
4,526,672 A * 7/1985 Reed ..... G01N 27/407 204/427
5,368,446 A 11/1994 Rode
(Continued)

FOREIGN PATENT DOCUMENTS

JP S59126192 8/1984
JP H0742686 2/1995

OTHER PUBLICATIONS

"Notice of Reasons for Refusal of Japan Counterpart Application", issued on Dec. 3, 2025, with English translation thereof, p. 1-p. 16.

*Primary Examiner* — Benjamin Doyle
(74) *Attorney, Agent, or Firm* — JCIPRNET

(57) ABSTRACT

A liquid pump device sucking and discharging liquid includes: a pump unit 50, rotating to make the liquid flow; a housing H, accommodating the pump unit and defining a passage 14 of the liquid; and a temperature sensor 80 having a tip region 80*a* protruded in the passage 14 of the liquid to measure a temperature of the liquid flowing on the passage 14.

18 Claims, 18 Drawing Sheets

(56) References Cited

U.S. PATENT DOCUMENTS 5,772,403 A * 6/1998 Allison ..... F04B 49/065 417/44.2
6,276,191 B1 * 8/2001 Schneider ..... G01N 27/407 73/23.31
6,375,434 B1 * 4/2002 Taivalkoski ..... B67D 7/20 418/2
6,604,417 B1 * 8/2003 Koike ..... G01F 1/699 73/204.22
6,663,349 B1 * 12/2003 Discenzo ..... F04D 15/0245 417/44.1
6,762,671 B2 * 7/2004 Nelson ..... G01K 7/223 374/185
7,056,013 B2 * 6/2006 Anderson ..... G01K 1/08 374/138
7,234,341 B2 * 6/2007 Nishio ..... G01N 27/407 73/23.31
7,539,549 B1 * 5/2009 Discenzo ..... F04D 15/0077 702/183
7,553,079 B1 * 6/2009 Khan ..... G01K 1/14 73/866.5
8,192,081 B2 * 6/2012 Suzuki ..... G01K 1/12 374/185
8,256,956 B2 * 9/2012 Suzuki ..... G01K 1/12 374/185
9,140,255 B2 * 9/2015 Wetherill ..... G01F 1/69
11,341,836 B2 * 5/2022 Gomez ..... F04D 15/0088
12,038,335 B2 * 7/2024 Lorenz ..... G01L 19/0092
2004/0134282 A1 * 7/2004 Hayashi ..... G01L 19/0092 73/708
2007/0095516 A1 * 5/2007 Saika ..... F28F 27/00 165/200
2007/0177993 A1 * 8/2007 Nakamichi ..... F04D 13/0673 417/354
2007/0242728 A1 * 10/2007 Althofer ..... F01N 13/008 374/208
2012/0112580 A1 * 5/2012 Sato ..... H02K 11/25 310/71
2015/0377098 A1 * 12/2015 Murakami ..... F04C 2/102 417/228
2016/0041040 A1 * 2/2016 Sosale ..... G01K 1/08 374/208
2018/0044157 A1 * 2/2018 Cohen ..... B67D 1/1231
2019/0339162 A1 * 11/2019 Munk ..... G01N 29/036
2022/0090597 A1 * 3/2022 Rosinski ..... F04C 2/102
2022/0243729 A1 * 8/2022 Lehnert ..... F04B 53/22
2022/0381244 A1 * 12/2022 Lehnert ..... F04C 28/28
2023/0349378 A1 * 11/2023 Schnittger ..... F04C 2/1071

* cited by examiner

LIQUID PUMP DEVICE

CROSS-REFERENCE TO RELATED APPLICATION

This application is a continuation application of and claims the priority benefit of U.S. patent application Ser. No. 17/890,226, filed on Aug. 17, 2022, which claims the priority benefit of Japan application serial no. 2021-139479, filed on Aug. 28, 2021 and Japan application serial no. 2022-085748, filed on May 26, 2022. The entirety of each of the above-mentioned patent applications is hereby incorporated by reference herein and made a part of this specification.

BACKGROUND

Technical Field

The invention relates to a liquid pump device that sucks and discharges liquid, and particularly relates to a liquid pump device including a temperature sensor detecting a temperature of liquid such as hydraulic oil.

Description of Related Art

As a conventional liquid pump device, an electric pump including a housing, a temperature sensor, a port block, a trochoid pump, a heat dissipation member, and a heat transfer member is known (see, for example, Patent Document 1). The housing accommodates a circuit substrate and a motor. The temperature sensor is mounted on the circuit substrate disposed inside the housing and detects the temperature of hydraulic oil. The port block is disposed in adjacency with the outer side of the housing. The trochoid pump is disposed between the pork block and the housing to make the hydraulic oil flow. The heat dissipation member is disposed between the inner wall of the housing and the circuit substrate. The heat transfer member is provided on the circuit substrate.

In the electric oil pump, the temperature sensor is configured to detect the temperature of the hydraulic oil via the housing and the heat transfer member and the heat dissipation member.

In the configuration of the temperature sensor, the heat of the hydraulic oil is discharged to intervening members, such as the housing and the heat discharge member, on the way of being transmitted to the temperature sensor. Therefore, the temperature sensor is unable to accurately detect the oil of the hydraulic oil.

Also, in the case where the temperature sensor is mounted to the liquid pump device, it is required that the assembling should be easy and the size should not increase.

Moreover, for liquid such as hydraulic oil, the heat transfer properties thereof are different from those of gas such as air that is less viscous and of a smaller mass. Also, when the temperature drops the flow may stagnate. Therefore, the behaviors of liquid need to be considered when measuring the temperature of liquid.

PRIOR ART DOCUMENT

Patent Document

[Patent Document 1] Japanese Laid-open No. 2014-125955

SUMMARY

The invention provides a liquid pump device allowing a temperature sensor to be easily assembled without increasing the size of the device and capable of accurately detecting the temperature of hydraulic oil.

A liquid pump device of the invention is configured as including: a pump unit, rotating to make liquid flow; a housing, accommodating the pump unit and defining a passage of the liquid; and a temperature sensor having a tip region protruded in the passage, so as to measure a temperature of the liquid flowing on the passage.

In the liquid pump device, it may also be configured that the temperature sensor includes: a cylindrical member that is bottomed and inserted into the passage of the liquid; and a sensor element disposed at a tip region inside the cylindrical member. The temperature sensor is disposed in a manner that the liquid flowing on the passage collides with the tip region of the cylindrical member.

In the liquid pump device, it may also be configured that the passage includes a first linear passage and a second linear passage intersecting and communicating with the first linear passage, and the temperature sensor is disposed in a manner that the tip region of the cylindrical member faces an intersection region between the first linear passage and the second linear passage.

In the liquid pump device, it may also be configured that the cylindrical member includes: a large diameter part, fit with an inner wall surface of the first linear passage; and a small diameter part, formed in a bottomed shape on a tip side with respect to the large diameter part, arranged with a gap with the inner wall surface of the first linear passage, and accommodating the sensor element. The small diameter part is disposed to face the intersection region between the first linear passage and the second linear passage.

In the liquid pump device, it may also be configured that the cylindrical member includes a surrounding wall part formed by a resin material and formed to be curved in a manner that a region opposite to the second linear passage is cut off to partially surround a periphery of the small diameter part.

In the liquid pump device, it may also be configured that the surrounding wall part has an outer wall surface opposite to the inner wall surface of the first linear passage.

In the liquid pump device, it may also be configured that the surrounding wall part has multiple projection parts projecting from the outer wall surface to abut against the inner wall surface of the first linear passage, so as to define a gap between the inner wall surface of the first linear passage and the outer wall surface.

In the liquid pump device, it may also be configured that the liquid pump device includes: a motor, having a driving shaft rotating around a predetermined axis to rotation-drive the pump unit; and a circuit substrate, to which a control unit controlling driving of the motor is mounted.

In the liquid pump device, it may also be configured that the temperature sensor is connected to the circuit substrate.

In the liquid pump device, it may also be configured that the housing includes: a housing body, defining a joining surface joined to an applicable target, a pump accommodation concave part accommodating the pump unit, a motor accommodation concave part accommodating the motor, and the passage of the liquid; and a pump cover, joined to the housing body and defining an opening part through which the liquid passes, so as to cover the pump accommodation concave part.

In the liquid pump device, it may also be configured that the housing includes: a through passage extending in parallel with the axis and penetrating through the housing body to be open to the joining surface, so as to define a portion of the passage of the liquid; and a communication passage, inclined with respect to the axis to extend and allowing the pump accommodation concave part to communicate with the through passage. The temperature sensor is disposed in a manner that the tip region faces an intersection region between the through passage and the communication passage In the liquid pump device, it may also be configured that the housing includes a motor cover joined to the housing body, so as to cover the motor accommodation concave part.

In the liquid pump device, it may also be configured that the temperature sensor includes: a cylindrical member that is bottomed and provided at the motor cover to be inserted into the through passage; and a sensor element, electrically connected to the circuit substrate to be disposed at a tip region inside the cylindrical member.

In the liquid pump device, it may also be configured that the cylindrical member includes: a large diameter part, fit with an inner wall surface of the through passage; and a small diameter part, formed in a bottomed shape on a tip side with respect to the large diameter part, arranged with a gap with the inner wall surface of the through passage, and accommodating the sensor element. The small diameter part is disposed at the intersection region between the through passage and the communication passage.

In the liquid pump device, it may also be configured that the cylindrical member includes a surrounding wall part formed by a resin material and formed to be curved in a manner that a region opposite to the communication passage is cut off to partially surround a periphery of the small diameter part.

In the liquid pump device, it may also be configured that the surrounding wall part has an outer wall surface opposite to the inner wall surface of the through passage.

In the liquid pump device, it may also be configured that the surrounding wall part has multiple projection parts projecting from the outer wall surface to abut against the inner wall surface of the through passage, so as to define a gap between the inner wall surface of the through passage and the outer wall surface.

In the liquid pump device, it may also be configured that the housing includes an outer cover joined to the motor cover to cover the circuit substrate disposed on an outer side of the motor cover.

In the liquid pump device, it may also be configured that the passage on which the temperature sensor is disposed is a discharge passage which discharges liquid pressurized by the pump unit.

In the liquid pump device, it may also be configured that the liquid pump device includes a filter member disposed upstream of an inlet port sucking the liquid to the pump unit. In the liquid pump device, it may also be configured that the pump unit is a trochoid-type pump unit including an inner rotor and an outer rotor.

DESCRIPTION OF THE EMBODIMENTS

The invention provides a liquid pump device allowing a temperature sensor to be easily assembled without increasing the size of the device and capable of accurately detecting the temperature of hydraulic oil.

In the following, the embodiments of the invention will be described with reference to the drawings.

Figure 1:
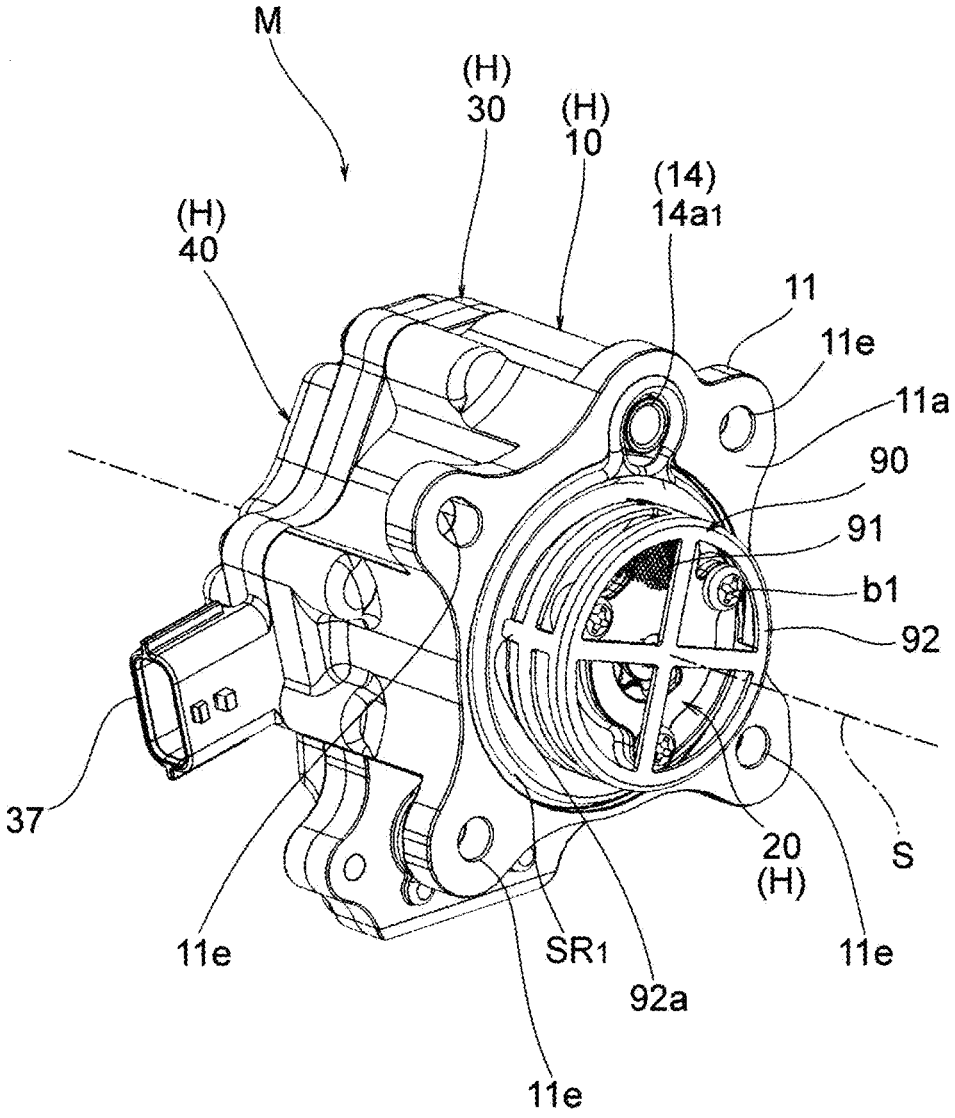
FIG. 1 is a perspective view illustrating the appearance of a liquid pump device according to a first embodiment of the invention.
Figure 2:
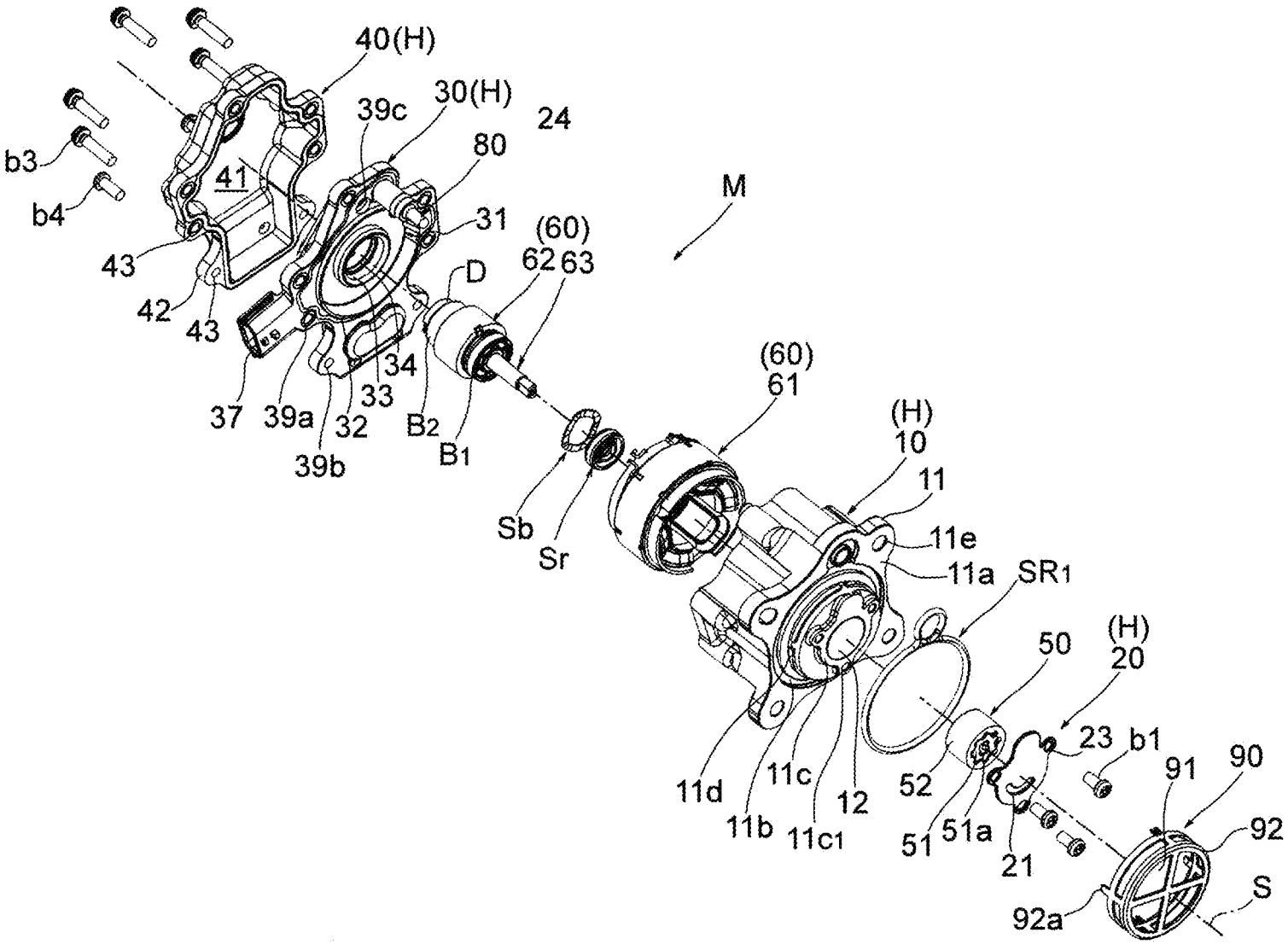
FIG. 2 is an exploded perspective view from a pump cover side, in which the liquid pump device according to the first embodiment is decomposed.
Figure 3:
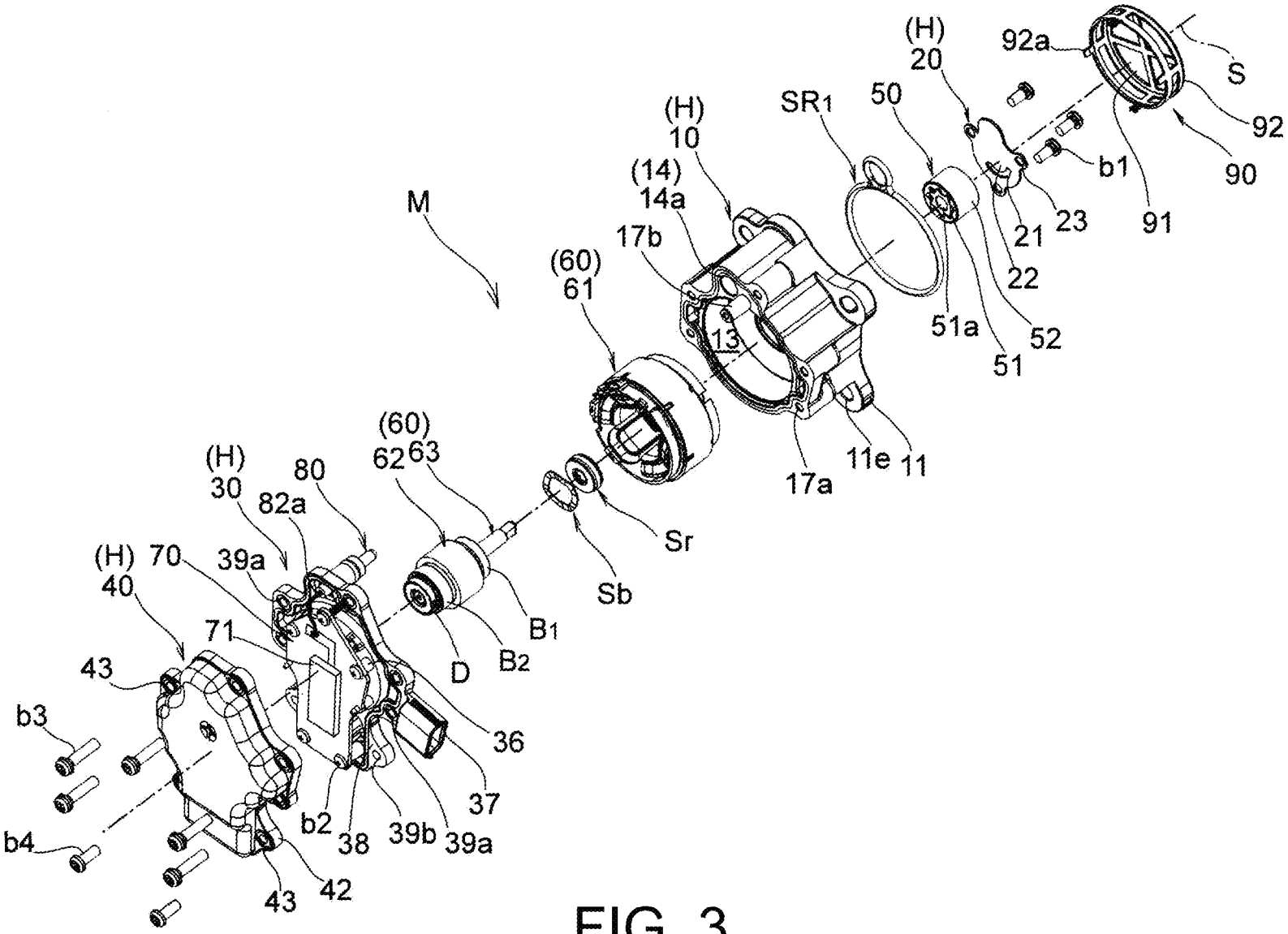
FIG. 3 is an exploded perspective view from an outer cover side, in which the liquid pump device according to the first embodiment is decomposed.

A liquid pump device M according to the first embodiment is an electric pump device targeting at hydraulic oil that is liquid. As shown in FIGS. 1 to 3, the liquid pump device M includes a housing body 10, a pump cover 20, a motor cover 30, an outer cover 40, a pump unit 50, a motor 60, a circuit substrate 70, a temperature sensor 80, and a filter member 90.

Here, a housing H of the liquid pump device M is formed by the housing body 10, the pump cover 20, the motor cover 30, and the outer cover 40.

Figure 11:
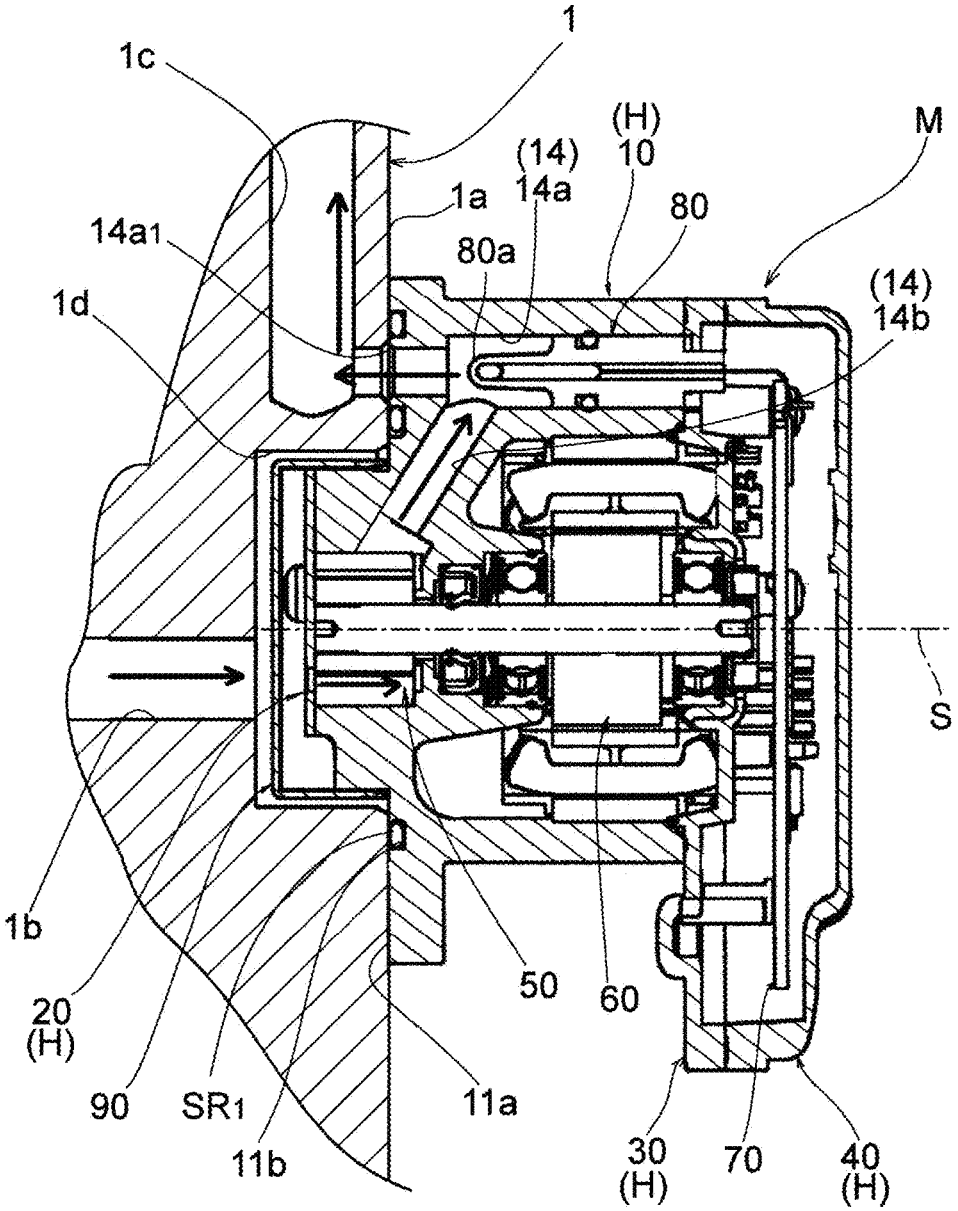
FIG. 11 is a cross-sectional view illustrating a state in which the liquid pump device according to the first embodiment is joined to be installed to an applicable target.

In addition, an applicable target 1 to which the liquid pump device M is applied, as shown in FIG. 11, includes a joining surface 1*a*, a hydraulic oil inlet passage 1*b*, a hydraulic oil outlet passage 1*c*, a fitting concave part 1*d*, and a screw hole (not shown). The applicable target 1, for example, is a cooling and lubrication system of a transmission device of a vehicle, a cooling and lubrication system of an engine, or another device requiring circulation of hydraulic oil.

The housing body 10 is formed by using a metal material, such as steel, cast iron, sintered steel, aluminum alloy, and, as shown in FIGS. 2, 3 and 5 to 7, includes a flange part 11, a pump accommodation concave part 12, a motor accommodation concave part 13, a discharge passage 14 as a passage through which liquid passes, an insertion hole 15 with an axis S as the center, a fitting concave part 16, and a joining surface 17.

The flange part 11 includes a joining surface 11*a* joined to the applicable target 1, an annular groove 11*b* formed on the joining surface 11*a*, an annular end surface 11*c*, and an outer peripheral wall 11*d* to which the filter member 90 is installed, and four holes 11*e* through which screws installed to the applicable target 1 pass.

The joining surface 11*a* is formed as a planar surface perpendicular to the axis S to be joined to the joining surface 1*a* of the applicable target 1.

The annular groove 11*b* is formed to receive a seal member $SR_1$ made of rubber and intervenes between the joining surface 11*a* and the joining surface 1*a* of the applicable target 1.

The annular end surface 11*c* is formed as a planar surface perpendicular to the axis S and includes three screw holes 11*c*; for screwing screws b1 fastening a pump cover 20 covering the pump covering concave part 12, so as to join the pump cover 20.

The outer peripheral wall 11*d* is formed at a position protruding in the direction of the axis S from the joining surface 11*a* and includes a locking groove on the radially outer peripheral surface, so as to install the filter member 90 by snap-fitting.

The pump accommodation concave part 12 is a region rotatably accommodates the pump unit 50, and includes an inner peripheral surface 12*a*, a bottom surface 12*b*, and an outlet 12*c* formed by recessing the bottom surface 12*b*.

The inner peripheral surface 12*a* forms a cylindrical surface with an axis offset from and in parallel with the axis S, and slidably supports the outer peripheral surface of an outer rotor 52 that forms a portion of the pump unit 50.

The bottom surface 12*b* slidably contacts an end surface on the inner side of the pump unit 50 in the direction of the axis S.

The outlet 12*c* is a region in which hydraulic oil pressurized by the pump unit 50 flows toward the discharge passage 14.

The motor accommodation concave part 13 is a region accommodating the motor 60, and includes an inner peripheral surface 13*a*, an inner peripheral surface 13*b*, and an inner peripheral surface 13*c*.

The inner peripheral surface 13*a* is formed as a cylindrical surface with the axis S as the center, so as to fit and fix a stator 61 of the motor 60.

The inner peripheral surface 13*b* is formed as a cylindrical surface with the axis S as the center, so as to fit and fix a bearing $B_1$ rotatably supporting a driving shaft 63 of the motor 60.

The inner peripheral surface 13*c* is formed as a cylindrical surface with the axis S as the center, so as to fit and fix a lip-type seal member Sr.

Figure 7:
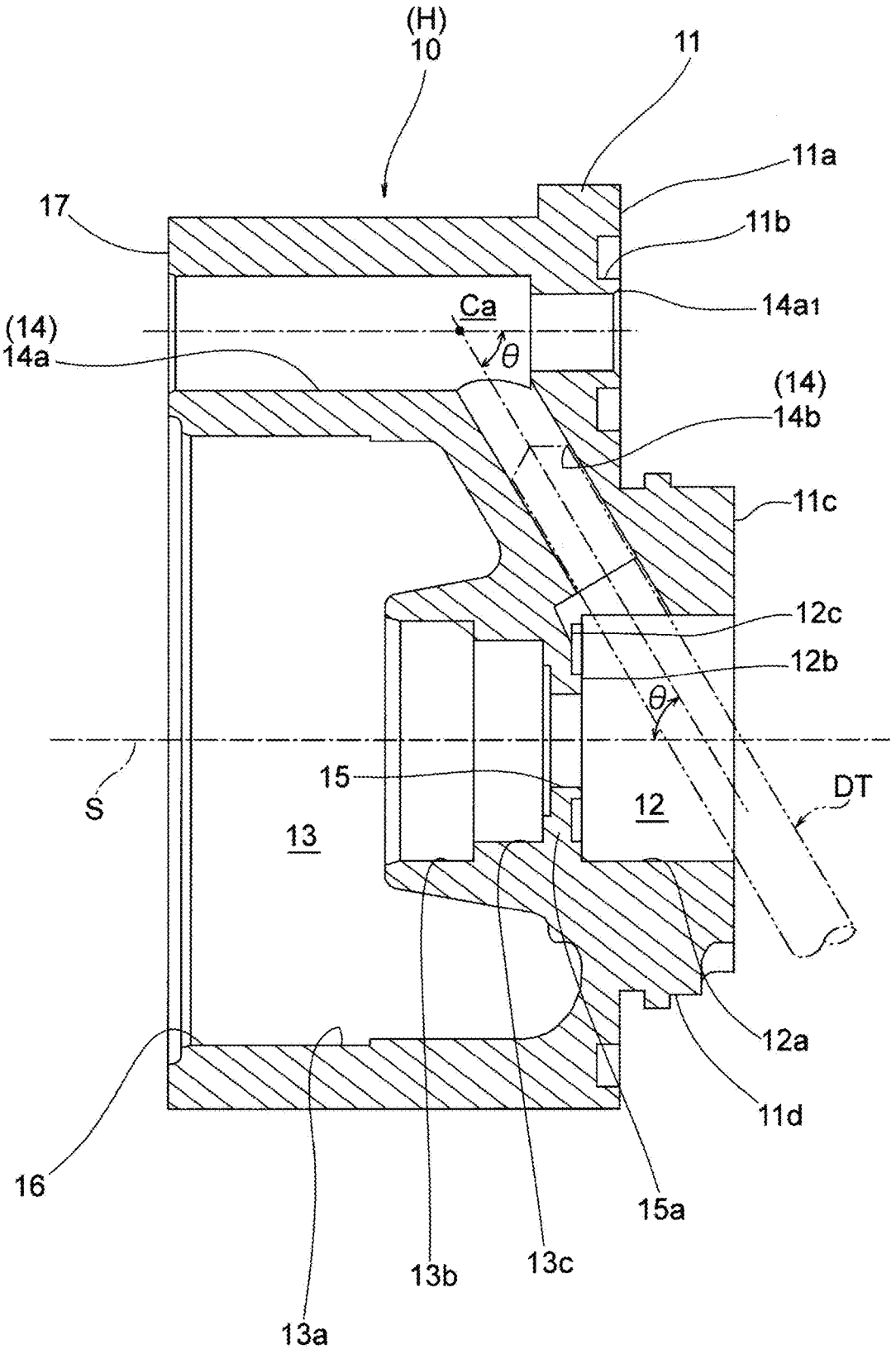
FIG. 7 is a cross-sectional view illustrating the housing body of the liquid pump device according to the first embodiment.

The discharge passage 14 is a passage which guides the hydraulic oil pressurized by the pump unit 50 to a discharge port 14*a*1 from a pump chamber, and, as shown in FIG. 7, includes a through passage 14*a* as a first linear passage and a communication passage 14*b* as a second linear passage.

The through passage 14*a* extends in parallel with the axis S from the joining surface 17 of the housing body 10, penetrates through the housing body 10, and is formed as a linear passage defining the discharge port 14*a*1 open on the joining surface 11*a* of the flange part 11. The communication passage 14*b* extends to incline at an angle θ with respect to the axis S, and is formed as a linear passage intersecting with the through passage 14*a*, so as to allow the outlet 12*c* of the pump chamber of the pump accommodation concave part 12 to communicate with the through passage 14*a* on the halfway.

Here, the angle θ at which the communication passage 14*b* with the through passage 14*a* is set to an angle at which a tool DT, such as a drill, can be inserted into the opening of the pump accommodation concave part 12 to perform hole processing.

In this way, the through passage 14*a* and the communication passage 14*b* as the discharge passage 14 are formed as linear passages. Therefore, processing can be easily performed through drill processing, etc. In particular, since the communication passage 14*b* is inclined at the angle θ with respect to the axis S, the communication passage 14*b* can be easily processed without affecting the shape of the pump accommodation concave part 12.

On a wall part 15*a* dividing the pump accommodation concave part 12 and the motor accommodation concave part 13, the insertion hole 15 is formed as a cylindrical hole with the axis S as the center, so that the driving shaft 63 passes through without contact.

The fitting concave part 16 defines a cylindrical surface with the axis S as the center at an outer end region of the motor accommodation concave part 13. Then, a fitting convex part 32 of the motor cover 30 is fit with the fitting concave part 16. That is, by fitting the fitting convex part 32 of the motor cover 30 with the fitting concave part 16 of the housing body 10, the center of a bearing cylindrical part 33 formed at the motor cover 30 is positioned coaxially with the axis S of the housing body 10.

The joining surface 17 is formed as a planar surface perpendicular to the axis S and includes five screw holes 17*a* for screwing screws fastening the motor cover 30 and a positioning protrusion 17*b* positioning the motor cover 30 around the axis S, so as to join the motor cover 30 covering the motor accommodation concave part 13.

The pump cover 20 is joined to the housing body 10 and fixed by the screws b1 and formed in a plate shape by using a material such as steel, cast iron, sintered steel, aluminum alloy, so as to cover the pump accommodation concave part 12 of the housing body 10.

Then, as shown in FIGS. 2 and 3, the pump cover 20 includes an inlet port 21 as the opening part for the hydraulic oil to pass through, an inner wall surface 22, and three circular holes 23 for the screws b1 to pass through.

The inlet port 21 guides the hydraulic oil into the pump chamber of the pump unit 50, and is formed in a crescent moon shape.

The inner wall surface 22 slidably receives an end surface on the outer side of the pump unit 50 accommodated in the pump accommodation concave part 12.

The motor cover 30 is joined to the housing body 10 and fixed by screws b3, so as to cover the motor accommodation concave part 13 of the housing body 10, and is formed by using a resin material.

In addition, as shown in FIGS. 2, 3, 8, and 9, the motor cover 30 includes a joining surface 31, the fitting concave part 32, the bearing cylindrical part 33, an opening part 34, a fitting hole 35, four boss parts 36, a connector 37 in which a terminal is embedded, a joining surface 38 joined to the outer cover 40, five circular holes 39*a* through which the screws b3 pass, two screw holes 39*b* for screwing the screws b4, and a fitting hole 39*c* fit with the positioning protrusion 17*b*.

The joining surface 31 is joined to the joining surface 17 of the housing body 10.

The fitting convex part 32 is fit with the fitting concave part 16 of the housing body 10, and positions the center of the bearing cylindrical part 33 on the axis S.

The bearing cylindrical part 33 is formed by pressing a metal molded product defining a cylindrical surface with the axis S as the center, so as to fit and fix a bearing B2 supporting the driving shaft 63 of the motor 60.

Figure 4:
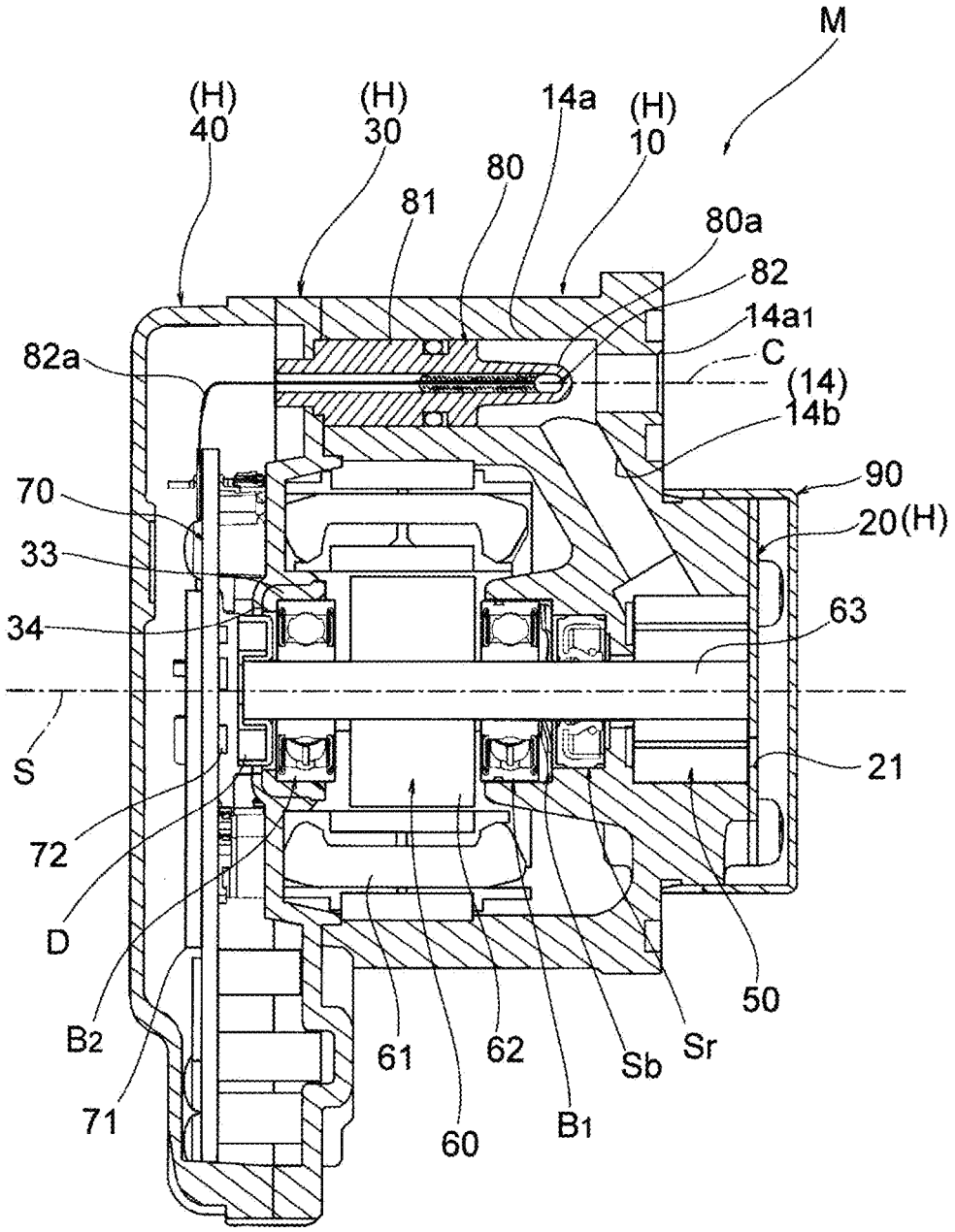
FIG. 4 is a cross-sectional view of the liquid pump device according to the first embodiment.
Figure 5:
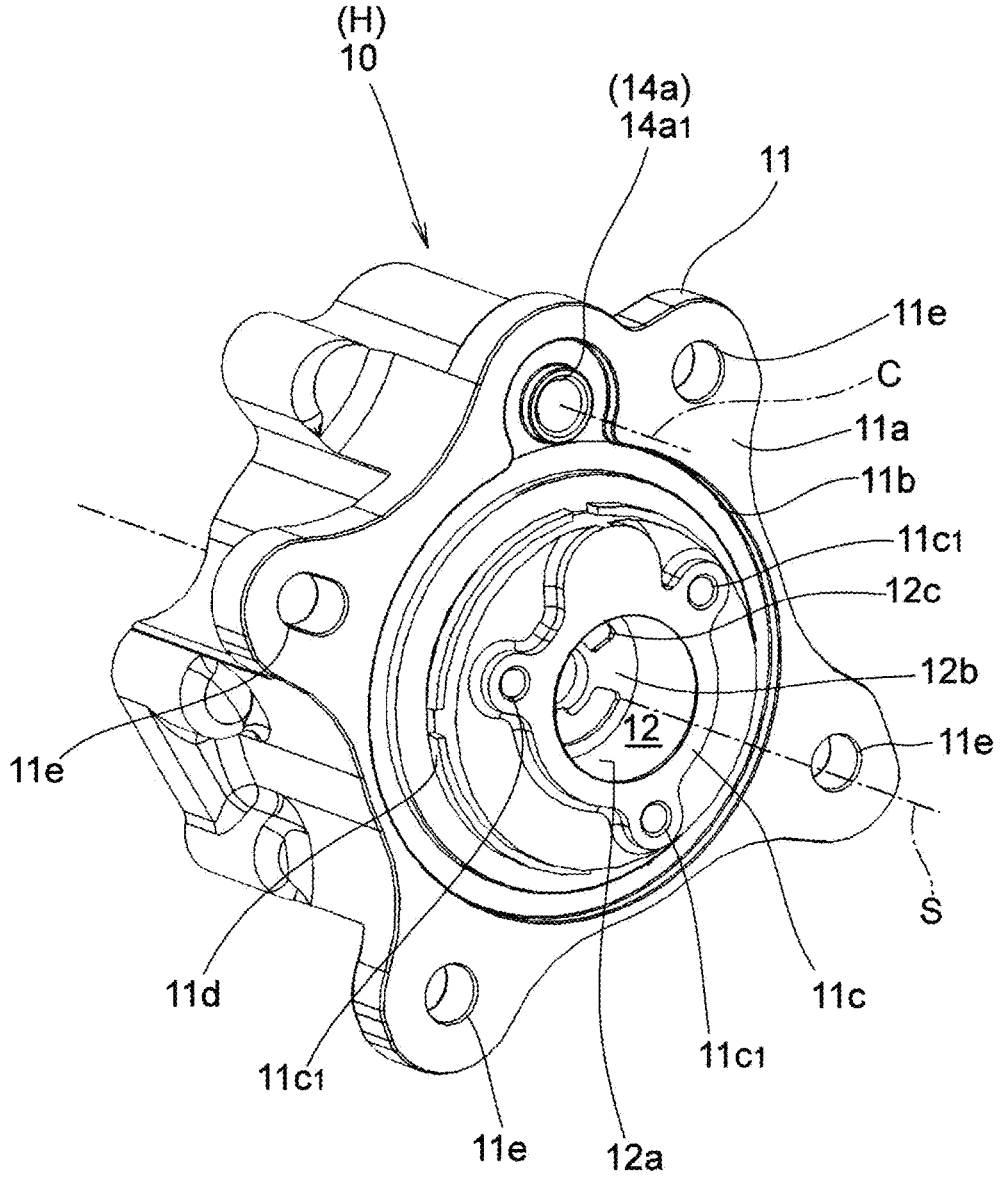
FIG. 5 is a perspective view illustrating a housing body of the liquid pump device according to the first embodiment.
Figure 6:
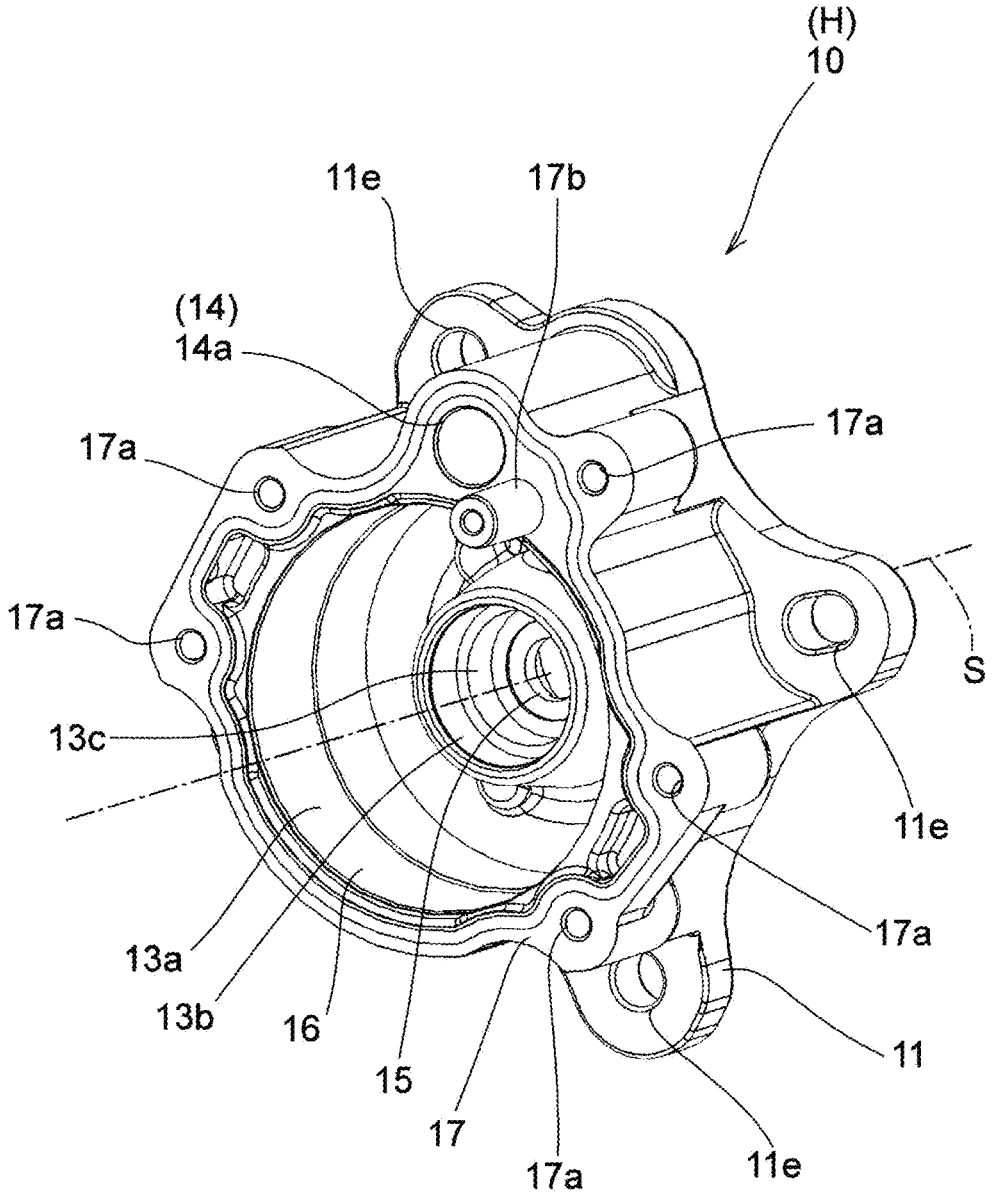
FIG. 6 is a perspective view illustrating the housing body of the liquid pump device according to the first embodiment.

As shown in FIG. 4, the opening part 34 is formed as a circular hole open coaxially with the bearing cylindrical part 33, so that a detected part D provided at an end of the driving shaft 63 is opposite to a detection sensor 72 provided on the circuit substrate 70.

The fitting hole 35 is formed to be open toward the direction of the axis S, so as to fit and fix a cylindrical member 81 forming a portion of the temperature sensor 80.

The boss parts 36 include screw holes for screwing the screws b2 that fasten the circuit substrate 70 provided on the outer side of the motor cover 30.

The outer cover 40 covers the circuit substrate 70 disposed on the outer side of the motor cover 30, and is formed by using a resin material. As shown in FIGS. 2 and 3, the outer cover 40 includes an accommodation part 41 accommodating the circuit substrate 70, a flange part 42 joined to the joining surface 38 of the motor cover 30, and seven circular holes 43 which are formed on the flange part 42 and through which the screws b3 and b4 for fastening pass.

In addition, in a state in which the circuit substrate 70 is installed to the motor cover 30, the flange part 42 of the outer cover 40 is joined to the joining surface 38 of the motor cover 30, and the outer cover 40 is combined with the housing body 10 with the motor cover 30 sandwiched therebetween by using the five screws b3, and combined with the motor cover 30 by using the two screws b4.

The pump unit 50 is disposed in the accommodation concave part 12 to apply pump effects of sucking, pressurizing, and discharging hydraulic oil, and is a trochoid-type pump including an inner rotor 51 and an outer rotor 52.

The inner rotor 51 is formed as an external gear with a tooth profile of a trochoidal curve by using a metal material such as steel or sintered steel. As shown in FIGS. 2 and 3, the inter rotor 51 includes an end surface sliding on the bottom surface 12*b* of the housing body 10, an end surface sliding on the inner wall surface 22 of the pump cover 20, a fitting hole 51*a* fit with the driving shaft 63, and a row of teeth (seven convex parts and seven concave parts) on the outer periphery.

Then, the inner rotor 51 integrally rotates with the driving shaft 63 in a direction, with the axis S as the center.

The outer rotor 52 is formed as an internal gear with a tooth profile able to be engaged with the inner rotor 51, and is formed by using a metal material such as steel or sintered steel. As shown in FIGS. 2 and 3, the outer rotor 52 includes an end surface sliding on the bottom surface 12*b* of the housing body 10, an end surface sliding on the inner wall surface 22 of the pump cover 20, an outer peripheral surface in a cylindrical shape and slidably in contact with the inner peripheral surface 12*a*, and a row of teeth (eight convex parts and eight concave parts) on the inner periphery.

The outer rotor 52 is linked with the rotation of the inner rotor 51 rotating with the axis S as the center, and, at a speed slower than the inner rotor 51, the outer rotor 52 rotates in the same direction as that of the inner rotor 51 with an axis offset from the axis S as the center.

In addition, by partially engaging the inner rotor 51 and the outer rotor 52, the pump effects of sucking, pressurizing, and discharging are generated continuously between the inner rotor 51 and the outer rotor 52.

The motor 60 is a three-phase brushless motor including the stator 61, the rotor 62, and the driving shaft 63.

The stator 61 includes a stator core formed by using a steel plate including a magnetic material, a bobbin formed by using a resin material exhibiting an electrically insulating property, and a coil wound around the bobbin.

The rotor 62 includes a rotor core formed by using a steel plate including a magnetic material, and a permanent magnet fit into the rotor core.

The driving shaft 63 is formed in a cylindrical columnar shape extending in the direction of the axis S by using a steel material, etc., and is fit with the rotor 62 to integrally rotate with the rotor 62.

In addition, one of the sides of the driving shaft 63 sandwiching the rotor 62 is supported by the bearing $B_1$ provided at the housing body 10, and the other side is supported by the bearing $B_2$ provided at the motor cover 30, and the driving shaft 63 are rotatably supported around the axis S.

In addition, a tip side of the driving shaft 63 with respect to the bearing $B_1$ is fit to the fitting hole 51*c* of the inner rotor 51, and transmits a rotation-driving force to the pump unit 50.

In addition, a lip-type seal member Sr is disposed in the outer periphery region between the bearing $B_1$ and the insertion hole 15 on the driving shaft 63, and the driving shaft 63 is sealed so that the hydraulic oil does not flow from the side of the pump accommodation concave part 12 toward the motor accommodation recess part 13.

As shown in FIGS. 3, 4, and 11, the circuit substrate 70 is formed in a plate shape and fixed to the motor cover 30 by using the screws b2.

On the circuit substrate 70, wirings are printed, and a control unit 71 controlling the driving of the motor 60 as well as various electronic components (not shown) are mounted. In addition, the detection sensor 72 is mounted on the inner side surface opposite to the opening part 34 of the motor cover 30.

The detection sensor 72 detects the rotation position of the rotor 62, and includes three Hall elements arranged in an arc shape with the axis S as the center to be opposite to the detected part D in the direction of the axis S.

In addition, a sensor element 82 forming a portion of the temperature sensor 80 is electrically connected to the circuit substrate 70.

The temperature sensor 80 measures the temperature of the hydraulic oil flowing through the discharge passage 14 as a passage of liquid, and includes a bottomed cylindrical member 81, and a sensor element 82 disposed at a tip region inside the cylindrical member 81.

Figure 8:
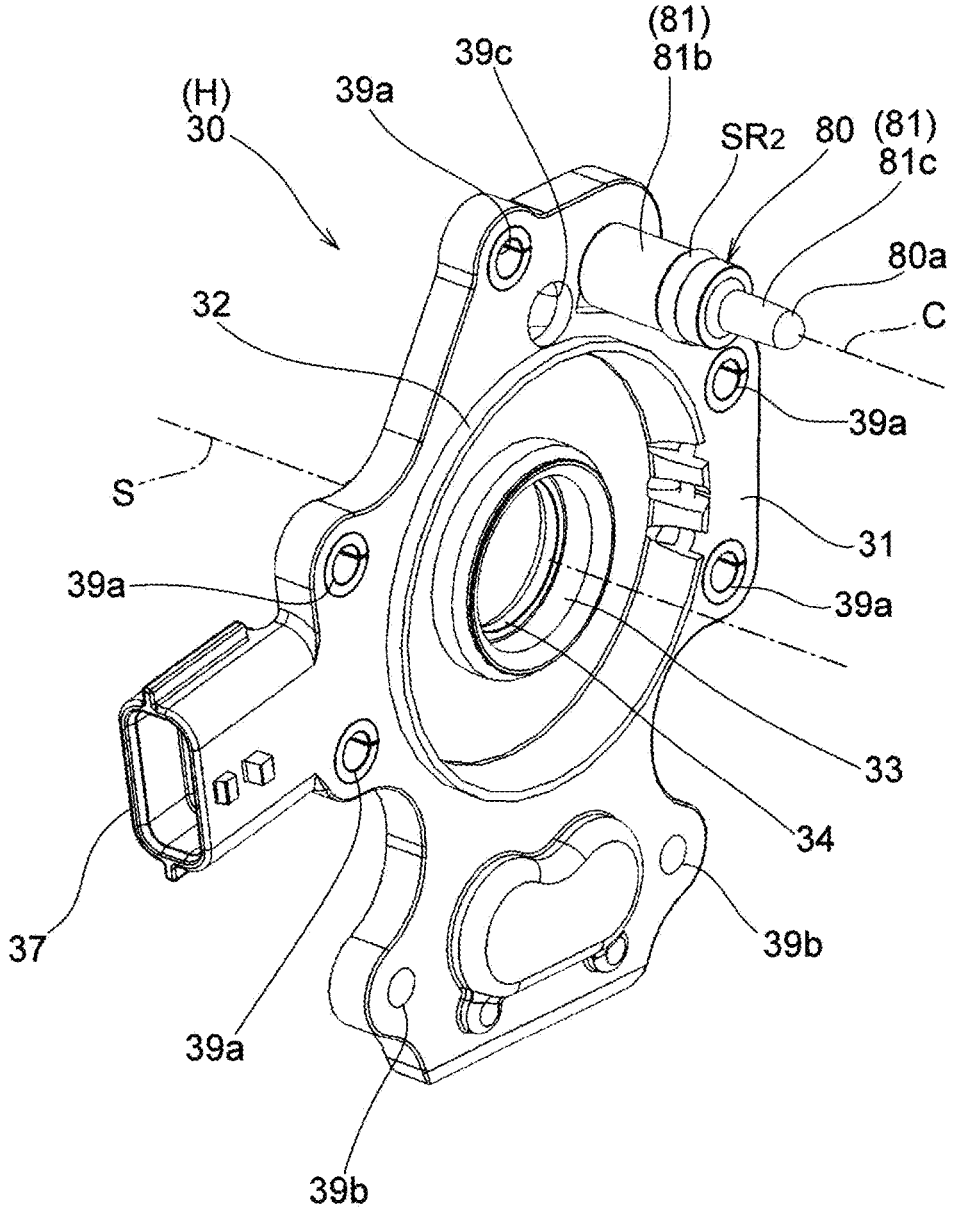
FIG. 8 is a perspective view illustrating a motor cover and a temperature sensor of the liquid pump device according to the first embodiment.
Figure 9:
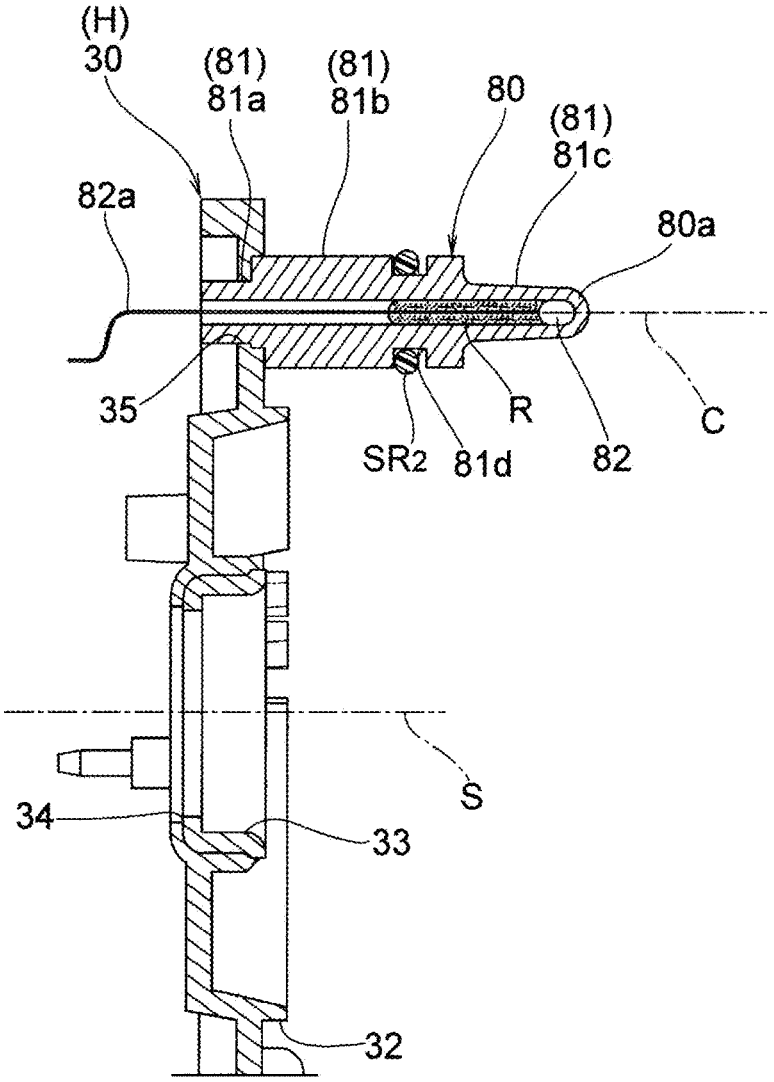
FIG. 9 is a partial cross-sectional view illustrating a motor cover and a temperature sensor of the liquid pump device according to the first embodiment.

As shown in FIGS. 8 and 9, the cylindrical member 81 is formed by using a resin material, so that a central line C thereof extends in parallel with the axis S in an assembled state. The cylindrical member 81 includes a fitting part 81*a*, a large diameter part 81*b*, a small diameter part 81*c*, and an annular groove 81*d*.

The fitting part 81*a* is formed to be fit to the fitting hole 35 of the motor cover 30. The large diameter part 81*b* is formed to be gaplessly fit to the inner wall surface of the through passage 14*a* in a state of being inserted into the through passage 14*a* of the housing body 10. The small diameter part 81*c* is located at a tip region 80*a* of the cylindrical member 81, formed to be bottomed on the tip side with respect to the large diameter part 81*b* and accommodates the sensor element 82 on the inner side, and is formed to be arranged with a gap with the inner wall surface of the through passage 14*a* in the state of being inserted into the through passage 14*a* of the housing body 10.

The annular groove 81*d* is formed to be close to the tip end side of the large diameter part 81*b*, so that an O-ring $SR_2$ in close contact with the inner wall surface of the through passage 14*a* is fit in.

The sensor element 82 is a thermistor, and is disposed on the inner side of the small diameter part 81*c* of the cylindrical member 81, that is, disposed at the tip region 80*a* of the cylindrical member 81. A lead wire 82*a* passes through the inside of the cylindrical member 81, and is electrically connected with a circuit wiring on the circuit substrate 70. In addition, the internal space of the cylindrical member 81 is filled with and sealed by a resin member R after the sensor element 82 is inserted.

In addition, the temperature sensor 80 is assembled in advance to the motor cover 30, and, in a state in which the circuit substrate 70 is installed to the motor cover 30, the motor cover 30 and the circuit substrate 70 are integrally handled by connecting the lead wire 82*a* of the sensor element 82 with the circuit wiring on the circuit substrate 70.

Accordingly, when the motor cover 30 is assembled to the housing body 10, since the temperature sensor 80 is inserted into the through passage 14*a*, the assembling can be simplified.

Figure 10:
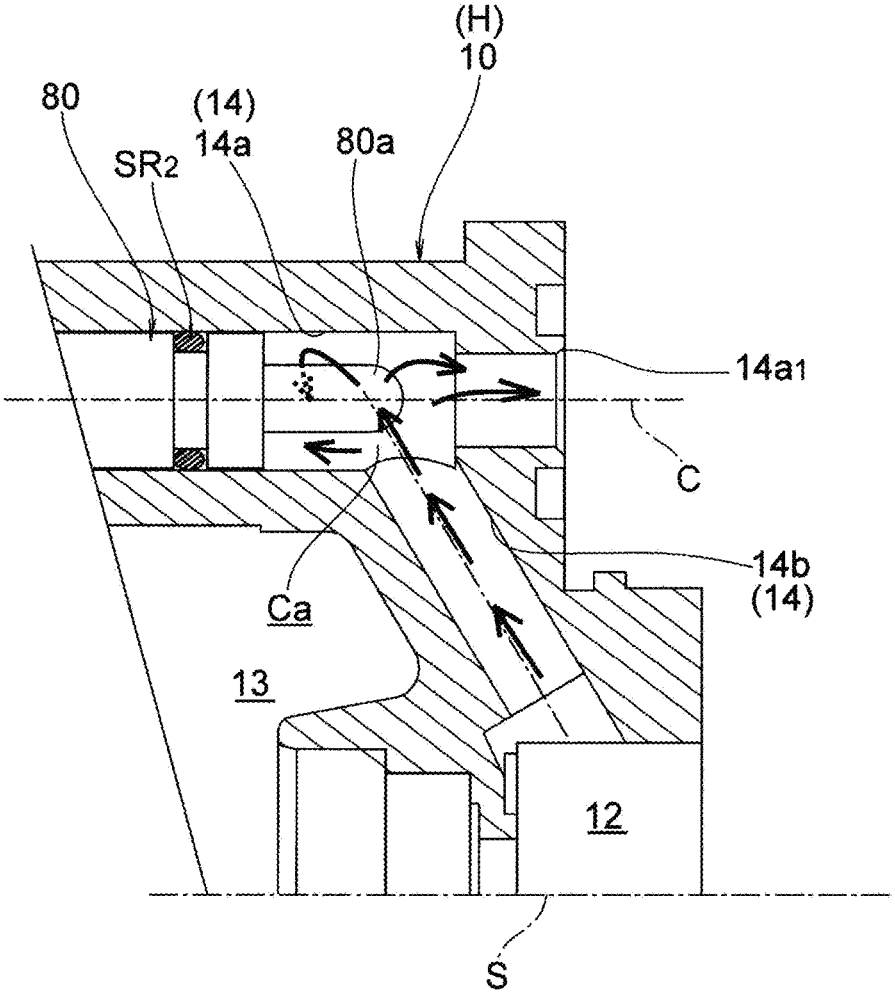
FIG. 10 is a schematic view illustrating a relation between a temperature sensor disposed in a passage and the flow of hydraulic oil in the liquid pump device according to the first embodiment.

In the state of being assembled, as shown in FIGS. 7 and 10, the tip region 80*a* of the temperature sensor 80 is disposed to face an intersection region Ca between the through passage 14*a* (the first linear passage) and the communication passage 14*b* (the second linear passage). Accordingly, the hydraulic oil flowing on the communication passage 14*b* collides with the tip region 80*a*, and then changes its direction to flow on the through passage 14*a* and is discharged from the discharge port $14a_1$.

That is, the temperature sensor 80 is protruded in the discharge passage 14, so as to measure the temperature of the hydraulic oil. As a result, the temperature sensor 80 can directly detect the temperature of the hydraulic oil flowing on the discharge passage 14 without heat being taken away by an intervening object as in the conventional art.

Specifically, the tip region 80*a* of the temperature sensor 80 not only is protrusive in the discharge passage 14, but is disposed in the intersection region Ca where the direction is changed from the communication passage 14*b* to the through passage 14*a*, as shown in FIG. 10. Therefore, the hydraulic oil collides with the tip region 80*a* and then flows to the downstream side after the collision without stagnation. Accordingly, the temperature sensor can accurately detect the temperature of the flowing hydraulic oil, instead of the stagnated hydraulic oil.

In addition, the tip region 80*a* of the temperature sensor 80 is formed as the small diameter part 81*c*, and forms a gap with the inner wall surface of the through passage 14*a*. Therefore, the outer wall surface of the tip region 80*a* is reliably exposed to the hydraulic oil, and the temperature of the hydraulic oil can be accurately detected.

The filter member 90 prevents impurities such as dust mixed into the hydraulic oil that is supplied from the upstream side of the applicable target 1 from entering the pump unit 50. As shown in FIG. 1, the filter member 90 includes a mesh part 91 where only the hydraulic oil passes through, and a frame part 92 holding the mesh part 91.

In addition, in the state in which the liquid pump device M is installed to the applicable target 1, as shown in FIG. 11, the filter member 90 is formed to be fit to the fitting concave part 1*d* open to the joining surface 1*a* of the applicable target 1. The frame part 92 includes a locking part 92*a*, as shown in FIGS. 2 and 3. In addition, the filter member 90 is assembled to the housing body 10 by fitting the locking part 92*a* to the outer peripheral wall 11*d* of the housing body 10 by snap-fitting.

Accordingly, by providing the filter member 90, the impurities can be prevented from flowing into the pump unit 50, and the malfunctioning due to the entry of the impurities into the pump unit 50 or the accumulation of the impurities inside the discharge passage 14 on which the hydraulic oil flows can be prevented. Accordingly, the tip region 80*a* of the temperature sensor 80 is constantly exposed to the hydraulic oil without being covered by the impurities, and the temperature of the hydraulic oil can be accurately detected.

Then, an assembling process of the liquid pump device M according to the first embodiment is described.

Before assembling, the housing body 10, the pump cover 20, the motor cover 30, the outer cover 40, the pump unit 50 (the inner rotor 51, the outer rotor 52), the motor 60 (the stator 61, the rotor 62, the driving shaft 63), the circuit substrate 70 on which the control unit 71 and various electronic components are mounted, the filter member 90, the bearings $B_1$ and $B_2$, a wave spring Sb as a thrust bearing, the lip-type seal member Sr, and the screws b1, b2, b3, and b4 are prepared.

In a subassembly process, the driving shaft 63 is fit and fixed to the rotor 62, and the bearings $B_1$ and $B_2$ and the detected part D are assembled to the driving shaft 63 in advance. In addition, the sensor element 82 is inserted into the cylindrical member 81 and sealed with the resin material R to form the temperature sensor 80. Then, the fitting part 81*a* of the temperature sensor 80 is fit to the fitting hole 35 to fix the temperature sensor 80 to the motor cover 30.

Then, the circuit substrate 70 is fixed to the boss parts 36 of the motor cover 30 by using the screws b2, and the lead wire 82*a* of the sensor element 82 is connected to the circuit wiring on the circuit substrate 70.

In a main assembly process, firstly, the motor 60 is built into the motor accommodation recess part 13 of the housing body 10. Specifically, the lip-type seal member Sr is fit to the inner peripheral surface 13*c*, and the stator 61 is fit and fixed to the inner circumferential surface 13*a*.

Then, the driving shaft 63 to which the rotor 62 is fit and fixed is inserted so that the wave spring Sb is sandwiched between the bearing $B_1$ and the lip-type seal member Sr. The bearing $B_1$ installed to one side of the driving shaft 63 is fit and fixed to the inner peripheral surface 13*b*, and a tip side region of the driving shaft 63 passes through the insertion hole 15 to protrude in the pump accommodation concave part 12.

Then, the motor cover 30 to which the circuit substrate 70 is installed approaches the housing body 10 from the direction of the axis S to cover the motor accommodation concave part 13. Then, the bearing $B_2$ installed to the other side of the driving shaft 63 is fit to the bearing cylindrical part 33 and inserted into the through passage 14*a* in a state in which the cylindrical part 81 of the temperature sensor 80 is fit with the O-ring $SR_2$, the positioning protrusion 17*b* is inserted to a fitting hole 39*c*, the fitting convex part 32 is fit to the fitting concave part 16, and the joining surface 31 is joined to the joining surface 17 of the housing body 10 via a liquid seal member. It is noted that the terminals and wirings extending from the stator 61 are appropriately guided to the outer side of the motor cover 30 to be connected with the circuit wirings on the circuit substrate 70.

Accordingly, the driving shaft 63 of the motor 60 is rotatably supported around the axis S by the housing body 10 and the motor cover 30 via the bearings $B_1$ and $B_2$.

Then, the outer cover 40 approaches the motor cover 30 to cover the circuit substrate 70 from the direction of the axis S, and the flange part 42 is joined to the joining surface 38 of the motor cover 30 via a liquid seal member. Then, the five screws b3 are screwed into the screw holes 17*a* of the housing body 10 through the circular holes 43 and 39*a*, and the two screws b4 are screwed to the screw holes 39*b* of the motor cover 30 through the circular holes 43.

Accordingly, the outer cover 40 sandwiches the motor cover 30 to be fastened and fixed to the housing body 10, and is fastened and fixed to the motor cover 30.

Then, the inner rotor 51 is inserted into the pump accommodation concave part 12 of the housing body 10, and is fit to integrally rotate with the driving shaft 63.

Then, the outer rotor 52 is inserted into the pump accommodation concave part 12 to be engaged with the inner rotor 51.

Then, the pump cover 20 approaches from the direction of the axis S to cover the pump accommodation concave part 12, and is joined to the annular end surface 11*c* of the housing body 10 to be engaged and fixed to the housing body 10 by the screws b1.

Then, the filter member 90 approaches the housing body 10 from the direction of the axis S to cover the pump cover 20, and the locking part 92*a* is fit and fixed to the outer peripheral wall 11*d* by snap-fitting.

Accordingly, the assembling of the liquid pump device M is completed. It is noted that the assembling procedure is not limited to the above, and another procedure may also be adopted.

In the following, in the case where the liquid pump device M is installed to the applicable target 1, the pump device M and the seal member $SR_1$ are prepared.

In addition, the seal member $SR_1$ is fit to the annular groove 11*b* of the joining surface 11*a*, and, as shown in FIG. 11, the filter member 90 is fit to the fitting concave part 1*d* of the applicable target 1 and the joining surface 11*a* is joined to the joining surface 1*a* of the applicable target 1. Then, screws are screwed into the screw holes of the applicable target 1 through the holes 11*e* of the housing body 10. Accordingly, the installation of the liquid pump device M to the applicable target 1 is completed.

In such state, the inlet passage 1*b* of the applicable target 1 is in communication with the inlet port 21 of the liquid pump device M through the filter member 90, and the discharge port 14*a*1 of the liquid pump device M is in communication with the outlet passage 1*c* of the applicable target 1.

Then, the pump operation of the liquid pump device M is described in the following. When the motor 60 is driving-controlled by the control unit 71, the driving shaft 63 and the inner rotor 51 rotate, and the outer rotor 52 is linked with the inner rotor 51 to rotate in the same direction, the hydraulic oil supplied via the inlet passage 1*b* is sucked into the pump chamber from the inlet port 21 and pressurized in the pump chamber.

In addition, the pressurized hydraulic oil flows through the discharge passage 14, that is, the communication passage 14*b*, to arrive at the intersection region Ca, collides with the tip region 80*a* of the temperature sensor 80 while changing the direction to flow through the through passage 14*a*, and is discharged from the discharge port 14*b* to be sent to the outlet passage 1*c* of the applicable target 1.

Figure 12:
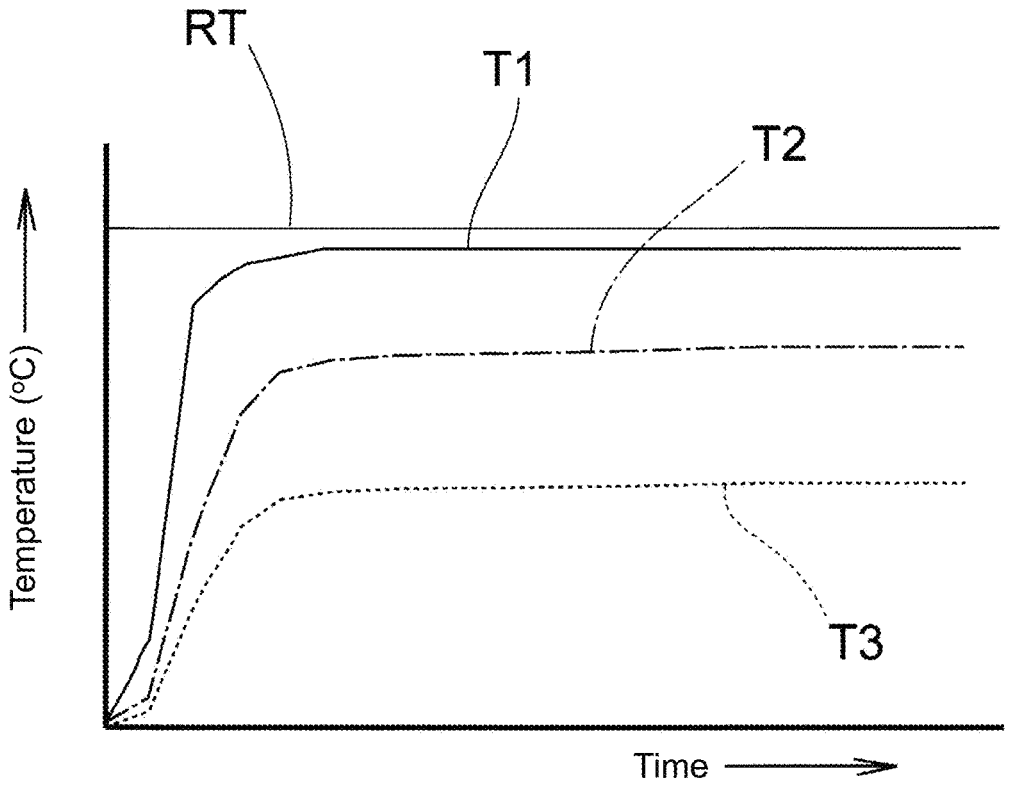
FIG. 12 is a graph illustrating detection properties of the temperature sensor in the liquid pump device of the invention.

In the above configuration, the temperature sensor 80 is protruded in the discharge passage 14 and is therefore able to directly detect the temperature of the flowing hydraulic oil. Here, the difference in detection accuracy when the protrusion amount by which the tip region 80*a* of the temperature sensor 80 protrudes in the passage of the hydraulic oil is examined through simulation. In FIG. 12, RT represents the actual temperature of the hydraulic oil in the passage, T3 represents a relationship curve of the detected temperature when no protrusion protrudes from the passage wall surface, T2 represents a relationship curve of the detected temperature when a protrusion amount of A mm protrudes from the passage wall surface, and T1 represents a relationship curve of the detected temperature when a protrusion amount of B mm protrudes from the passage wall surface, where B>A. As a result, as shown in FIG. 12, as the protrusion amount of the temperature sensor 80 in the passage increases, the detection accuracy increases.

That is, in the configuration in which the tip region 80*a* of the temperature sensor is disposed to be simply exposed to the hydraulic oil without being protrusive in the passage, the detection accuracy is low, and as the protrusion amount of the tip region 80*a* of the temperature sensor increases, the detection accuracy increases.

Specifically, in the embodiment, the tip region 80*a* of the temperature sensor 80 is disposed to face the intersection region Ca between the through passage 14*a* and the communication passage 14*b*. Therefore, the temperature sensor 80 can accurately detect the temperature of the hydraulic oil.

As described above, according to the liquid pump device M of the first embodiment, the tip region 80*a* of the temperature sensor 80 is protruded in the passage (discharge passage 14) of the hydraulic oil. Therefore, the temperature of the hydraulic oil can be directly detected, and the heat is not being taken away by an intervening object as in the conventional art.

In addition, the temperature sensor 80 is disposed in a manner that the hydraulic oil flowing through the passage (discharge passage 14) collides with the tip region 80*a*. Specifically, the tip region 80*a* is disposed to face the intersection region Ca between the through passage 14*a* and the communication passage 14*b*. Therefore, instead of detecting the temperature of the stagnated hydraulic oil, the temperature sensor can accurately detect the temperature of the flowing hydraulic oil.

Specifically, the tip region 80*a* of the temperature sensor 80 is formed to include the large diameter part 81*b* gaplessly fit to the inner wall surface of the through passage 14*a* and the small diameter part 81*c* arranged with the gap with the inner wall surface of the through passage 14*a* and accommodating the sensor element 82. Therefore, the hydraulic oil can be actively guided to the periphery of the small diameter part 81*c*. That is, by actively exposing the small diameter part 81*c* accommodating the sensor element 82 to the hydraulic oil, the heat of the hydraulic oil can be effectively sensed. Therefore, the temperature of the hydraulic oil can be accurately detected.

In addition, according to the hydraulic pump device M according to the first embodiment, by integrally incorporating the temperature sensor 80 with the circuit substrate 70 and assembling the motor cover 30 to which the circuit substrate 70 is installed to the housing body 10, the temperature sensor 80 can be inserted into the passage (through passage 14*a*). Therefore, compared with the configuration of separate assembling, the assembling process can be simplified, and the overall assembling man-hours can also be reduced.

In addition, the temperature sensor 80 is formed by the cylindrical member 81 directly exposed to the hydraulic oil and the sensor element 82 disposed inside the tip region 80*a* of the cylindrical member 81. Therefore, the sensor element 82 is prevented from being damaged, the heat of the hydraulic oil is suppressed from being transmitted to another member, and the temperature of the hydraulic oil can be accurately detected.

In addition, according to the liquid pump device M of the first embodiment, the temperature sensor 80 is protruded in the passage (the discharge passage 14) formed in the housing body 10 and formed to extend in the same direction (the direction of the axis S) as the assembling direction of the motor cover 30. Therefore, compared with the configuration in which the temperature sensor protrudes to the outer side of the housing, the size of the device can be prevented from increasing, and the temperature sensor 80 can be directly exposed to the hydraulic oil.

Figure 13:
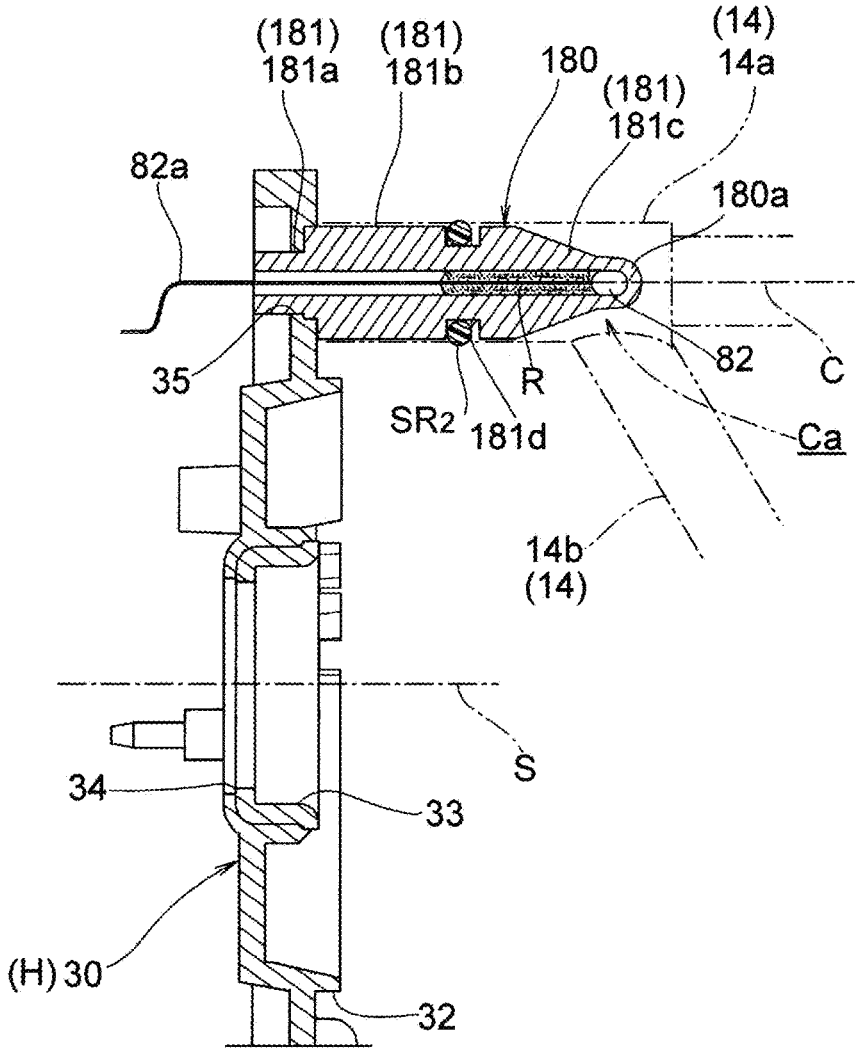
FIG. 13 is a cross-sectional view illustrating a motor cover and a temperature sensor of a liquid pump device according to a second embodiment.
Figure 14:
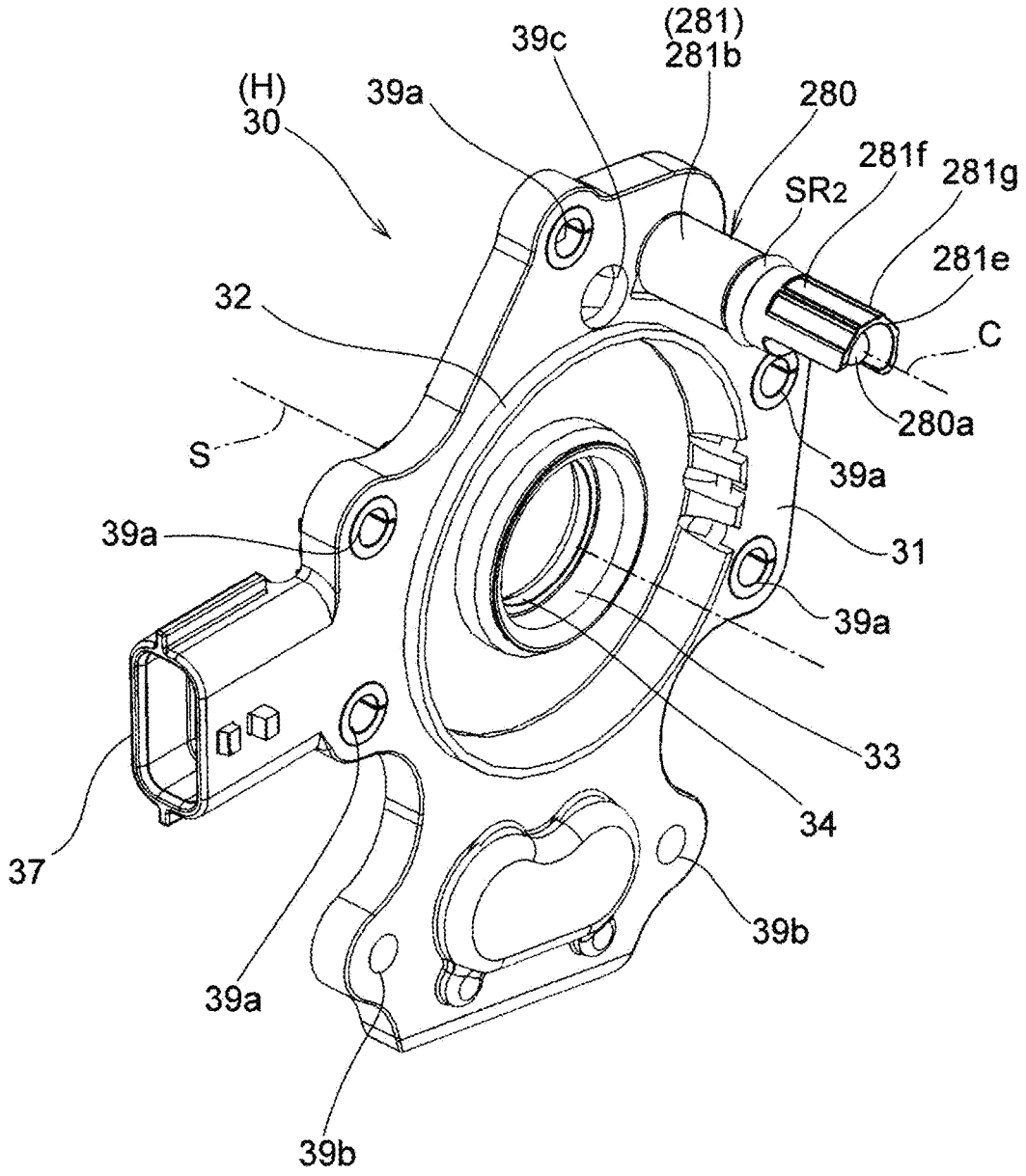
FIG. 14 is a cross-sectional view illustrating a motor cover and a temperature sensor of a liquid pump device according to a third embodiment.
Figure 15:
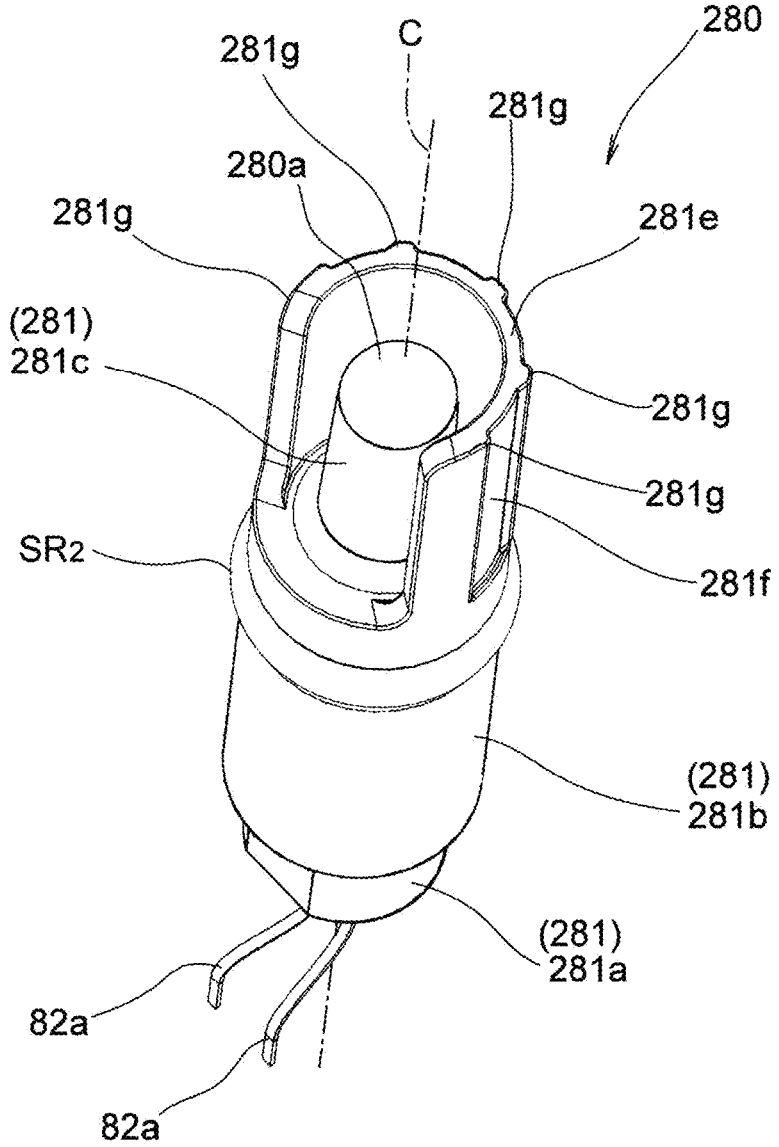
FIG. 15 is a perspective view illustrating the temperature sensor of a liquid pump device according to the third embodiment.
Figure 16:
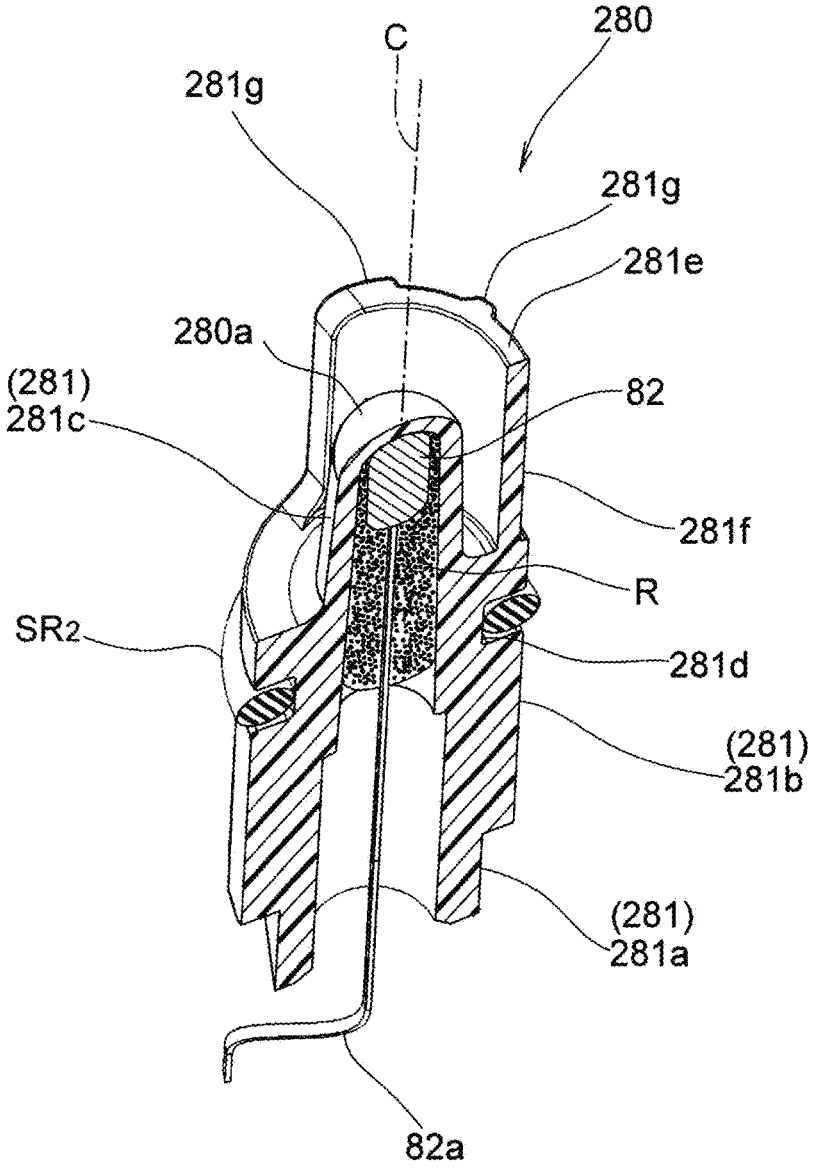
FIG. 16 is a perspective cross-sectional view illustrating the temperature sensor of the liquid pump device according to the third embodiment, the cross-sectional view being taken along a plane including a central line thereof.

FIG. 13 illustrates a temperature sensor 180 included in a liquid pump device according to a second embodiment of the invention. The temperature sensor 180 adopts a cylindrical member 181, in place of the cylindrical member 81 of the temperature sensor 80 of the liquid pump device according to the first embodiment. Configurations same as those of the first embodiment are labeled with the same reference symbols, and the descriptions thereof are omitted.

In the liquid pump device according to the second embodiment, the temperature sensor 180 includes the cylindrical member 181 and the sensor element 82.

The cylindrical member 181 is formed by using a resin material, so that the central line C thereof extends in parallel with the axis S in an assembled state. The cylindrical member 181 includes a fitting part 181*a*, a large diameter part 181*b*, a conical part 181*c*, and an annular groove 181*d*.

The fitting part 181*a* is fit to the fitting hole 35 of the motor cover 30.

The large diameter part 181*b* is fit gaplessly to the inner wall surface of the through passage 14*a* in a state of being inserted into the through passage 14*a* of the housing body 10.

The conical part 181*c* has a tip region 180*a* of the cylindrical member 181, formed to be tapered and bottomed on the tip side with respect to the large diameter part 181*b* and accommodates the sensor element 82 on the inner side, and is formed to be arranged with the gap with the inner wall surface of the through passage 14*a* in the state of being inserted into the through passage 14*a* of the housing body 10.

The annular groove 181*d* is formed at the region of the large diameter part 181*b*, so that the O-ring $SR_2$ in close contact with the inner wall surface of the through passage 14*a* is fit in.

In the state of being assembled, the tip region 180*a* of the temperature sensor 180 according to the second embodiment is disposed to face the intersection region Ca between the through passage 14*a* (the first linear passage) and the communication passage 14*b* (the second linear passage).

Accordingly, the hydraulic oil flowing on the communication passage 14*b* collides with the tip region 180*a*, and then changes its direction to flow on the through passage 14*a* and is discharged from the discharge port 14*a*1.

That is, the temperature sensor 180 is protruded in the discharge passage 14, so as to measure the temperature of the hydraulic oil. As a result, the temperature sensor 180 can directly detect the temperature of the hydraulic oil flowing on the discharge passage 14 without heat being taken away by an intervening object as in the conventional art.

Specifically, the tip region 180*a* of the temperature sensor 180 not only is protrusive in the discharge passage 14, but is disposed in the intersection region Ca where the direction is changed from the communication passage 14*b* to the through passage 14*a*. Therefore, the hydraulic oil collides with the tip region 180*a* and then flows to the downstream side without stagnation. Accordingly, the temperature sensor can accurately detect the temperature of the flowing hydraulic oil, instead of the stagnated hydraulic oil.

In addition, the tip region 180*a* of the temperature sensor 180 is a region on the tip side of the conical part 181*c* formed in a tapered shape. Therefore, a gap is formed with the inner wall surface of the through passage 14*a*. Therefore, the outer wall surface of the tip region 180*a* is reliably exposed to the hydraulic oil, and the temperature of the hydraulic oil can be accurately detected.

FIGS. 14 to 18 illustrate a temperature sensor 280 included in a liquid pump device according to a third embodiment of the invention. The temperature sensor 280 adopts a cylindrical member 281, in place of the cylindrical member 81 of the temperature sensor 80 of the liquid pump device according to the first embodiment. Configurations same as those of the first embodiment are labeled with the same reference symbols, and the descriptions thereof are omitted.

In the liquid pump device according to the third embodiment, the temperature sensor 280 includes the cylindrical member 281 and the sensor element 82.

The cylindrical member 281 is formed by using a resin material, so that the central line C thereof extends in parallel with the axis S in an assembled state. The cylindrical member 281 includes a fitting part 281*a*, a large diameter part 281*b*, a small diameter part 281*c*, an annular groove 281*d*, a surrounding wall part 281*e*, an outer wall surface 281*f*, and multiple projection parts 281*g*.

The fitting part 281*a* is fit to the fitting hole 35 of the motor cover 30.

The large diameter part 281*b* is fit gaplessly to the inner wall surface of the through passage 14*a* in a state of being inserted into the through passage 14*a* of the housing body 10.

The small diameter part 281*c* is located at a tip region 280*a* of the cylindrical member 281, formed to be bottomed on the tip side with respect to the large diameter part 281*b* and accommodates the sensor element 82 on the inner side, and is formed to be arranged with the gap with the inner wall surface of the through passage 14*a* in the state of being inserted into the through passage 14*a* of the housing body 10.

The annular groove 281*d* is formed at the region of the large diameter part 281*b*, so that the O-ring $SR_2$ in close contact with the inner wall surface of the through passage 14*a* is fit in.

A region of the surrounding wall part 281*e* opposite to the communication passage 14*b* is cut off, and the surrounding wall part 281*c* is formed to be curved so as to partially surround the periphery of the small diameter part 281*c*, so that the surrounding wall part 281*e* collides with the hydraulic oil flowing from the communication passage 14*b* toward the small diameter part 281*c*.

The outer wall surface 281*f* is formed as a cylindrical surface with the central line C as the center, so as to be opposite to the inner wall surface of the through passage 14*a* in predetermined gaps.

The projection parts 281*g* radially protrude from the outer wall surface 281*f* to extend in the direction of the central line C and are formed to abut against the inner wall surface of the through passage 14*a*, so as to define the predetermined gaps between the inner wall surface of the through passage 14*a* and the outer wall surface 281*f*.

Figure 17:
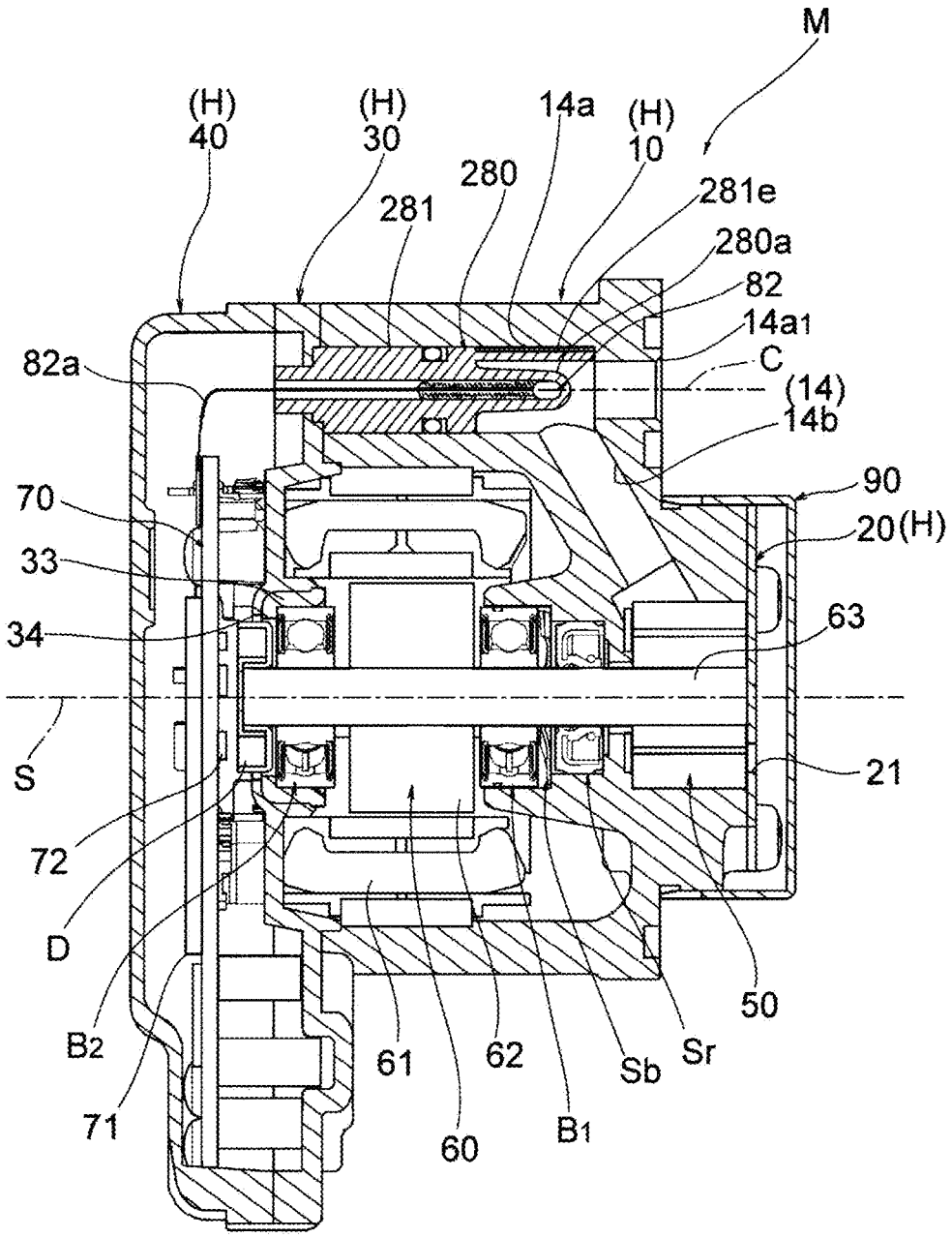
FIG. 17 is a cross-sectional view of the liquid pump device according to the third embodiment.
Figure 18:
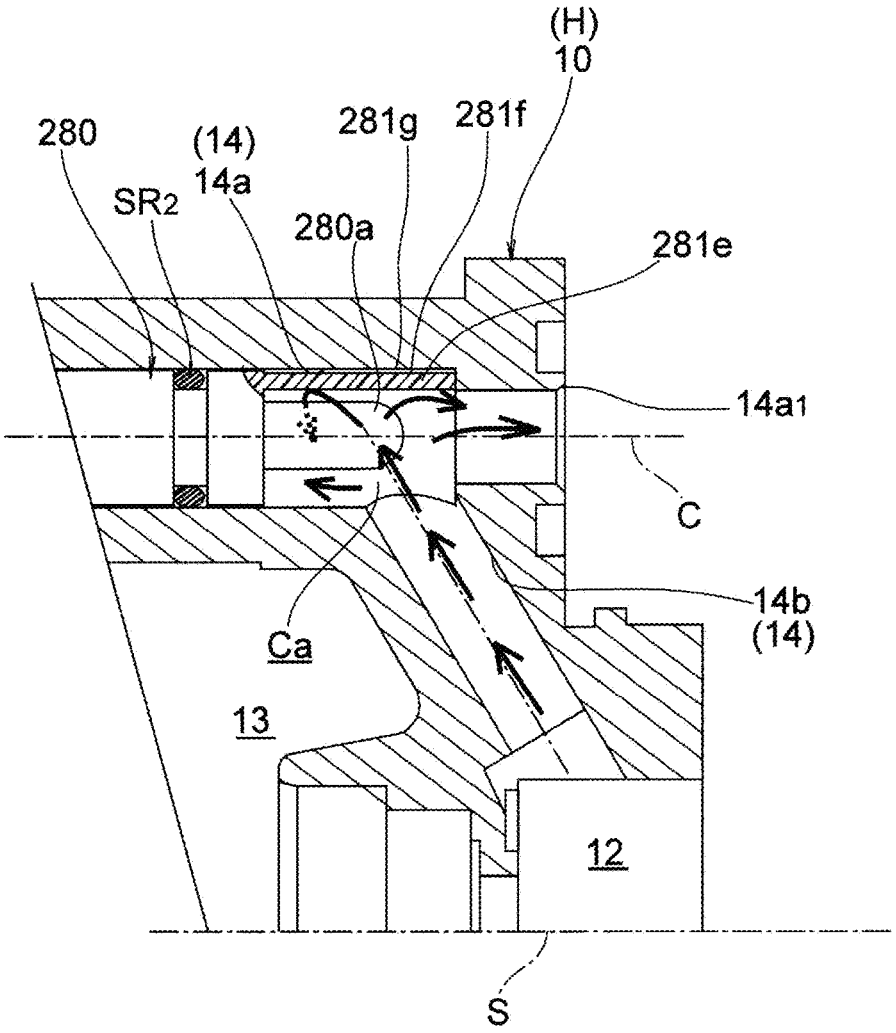
FIG. 18 is a schematic view illustrating a relation between the temperature sensor disposed in a passage and the flow of hydraulic oil in the liquid pump device according to the third embodiment.

In the state of being assembled, as shown in FIGS. 17 and 18, the tip region 280*a* of the temperature sensor 280 of the third embodiment is disposed to face the intersection region Ca between the through passage 14*a* (the first linear passage) and the communication passage 14*b* (the second linear passage).

Accordingly, the hydraulic oil flowing on the communication passage 14*b* collides with the tip region 280*a*, and then changes its direction to flow on the through passage 14*a* and is discharged from the discharge port 14*a*1.

That is, the temperature sensor 280 is protruded in the discharge passage 14, so as to measure the temperature of the hydraulic oil. As a result, the temperature sensor 280 can directly detect the temperature of the hydraulic oil flowing on the discharge passage 14 without heat being taken away by an intervening object as in the conventional art.

Specifically, the tip region 280*a* of the temperature sensor 280 not only is protrusive in the discharge passage 14, but is disposed in the intersection region Ca where the direction is changed from the communication passage 14*b* to the through passage 14*a*. Therefore, the hydraulic oil collides with the tip region 280*a* and then flows to the downstream side without stagnation. Accordingly, the temperature sensor can accurately detect the temperature of the flowing hydraulic oil, instead of the stagnated hydraulic oil.

In addition, the tip region 280*a* of the temperature sensor 280 is formed as the small diameter part 281*c*, and forms a gap with the inner wall surface of the through passage 14*a*. Therefore, the outer wall surface of the tip region 280*a* is reliably exposed to the hydraulic oil, and the temperature of the hydraulic oil can be accurately detected.

Moreover, in the temperature sensor 280, the surrounding wall part 281*e* formed by a resin material to be curved to partially surround the periphery of the small diameter part 281*c* is provided, so as to collide with the hydraulic oil flowing from the communication passage 14*b* toward the small diameter part 281*c*.

As shown in FIG. 18, the surrounding wall 281*e* suppresses the hydraulic oil flowing toward the small diameter part 281*c* from contacting the inner wall surface of the through passage 14*a* of the housing body 10. That is, the surrounding wall part 281*e* suppresses the heat of the hydraulic oil from being transmitted and spreading to the housing body 10 formed by a metal material. Accordingly, the temperature of the hydraulic oil can be accurately detected.

In addition, the temperature sensor 280 is provided with the outer wall surface 281*f* opposite to the inner wall surface of the through passage 14*a* in the gaps with the inner wall surface. Therefore, the heat transmitted from the surrounding wall part 281*e* to the housing body 10 can be suppressed.

Moreover, the temperature sensor 280 is provided with the projection parts 281*g* radially protruding from the outer wall surface 281*f* to abut against the inner wall surface of the through passage 14*a*. Therefore, the surrounding wall 281*e* can be fixed to the housing body 10, and relative vibrations, etc., with respect to the housing body 10 can be suppressed or prevented.

In the first to third embodiments, as embodiments in which the temperature sensor 80, 180, 280 is protruded in the passage, the temperature sensor 80, 180, 280 is disposed to face the intersection region Ca between the through passage 14*a* as the first linear passage and the communication passage 14*b* as the second linear passage. However, the invention is not limited thereto. The temperature sensor may also be disposed to face an intersection region between the first linear passage and the second linear passage that forms other configurations, or the temperature sensor may not be disposed at the intersection region of two linear passages as long as the temperature sensor is protruded in a passage.

In the first to third embodiments, as the housing, the housing H including the housing body 10, the pump cover 20, the motor cover 30, and the outer cover 40 is shown. However, the invention is not limited thereto. A configuration in which the pump cover 20 is omitted and the joining surface of the applicable target serves as the pump cover may also be adopted, or a housing of another configuration may also be adopted.

In the first to third embodiments, the discharge passage 14 is adopted as the passage in which the temperature sensor 80, 180, 280 is protruded. However, the invention is not limited thereto. The temperature sensor may also be disposed to be protrusive in an inlet passage sucking the hydraulic oil to the pump chamber of the pump unit 50.

In the third embodiment, a configuration in which the temperature sensor 280 has the outer wall surface 281*f* opposite to the inner wall surface of the through passage 14*a* in the gaps with the inner wall surface and the projection parts 281*g* abutting against the inner wall surface of the through passage 14*a* is shown. However, the invention is not limited thereto. A configuration in which the projection parts 281*g* are omitted and the outer wall surface 281*f* is opposite to the inner wall surface of the through passage 14*a* in the gaps with the inner wall surface or the projection parts 281*g* are omitted and the outer wall surface 281*f* is in close contact with and opposite to the inner wall surface of the through passage 14*a* may also be adopted.

In the above embodiments, the trochoid-type pump unit 50 including the inner rotor 51 and the outer rotor 52 is shown as the pump unit. However, the invention is not limited thereto. A vane-type pump unit or a pump unit of another configuration may also be adopted.

In the above embodiments, a configuration including the filter member 90 is shown. However, the invention is not limited thereto. A configuration omitting the filter member 90 may also be adopted, or a configuration in which a filter member is disposed on the side of the applicable target may also be adopted.

As described above, in the liquid pump device of the invention, the temperature sensor can be easily assembled without increasing the device size and can accurately measure the temperature of the liquid. Therefore, in addition to the hydraulic oil as liquid, the liquid pump device may also be applicable to other liquid pump devices targeting at other liquid.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A liquid pump device, comprising:

a pump unit, rotating to make liquid flow;

a housing, accommodating the pump unit and defining a passage of the liquid; and a temperature sensor having a tip region protruded in the passage, so as to measure a temperature of the liquid flowing on the passage, wherein the temperature sensor comprises: a cylindrical member that is bottomed and inserted into the passage; and a sensor element disposed at a tip region inside of the cylindrical member, and the temperature sensor is disposed in a manner that the liquid flowing on the passage collides with the tip region of the cylindrical member, and the cylindrical member comprises a small diameter part accommodating the sensor element and a surrounding wall part formed to be curved so as to partially surround a periphery of the small diameter part, wherein the passage comprises a first linear passage and a second linear passage intersecting and communicating with the first linear passage, and the surrounding wall part is formed by a resin material and formed to be curved in a manner that a region opposite to the second linear passage is cut off to partially surround the periphery of the small diameter part.

2. The liquid pump device as claimed in claim 1, wherein the temperature sensor is disposed in a manner that the tip region of the cylindrical member faces an intersection region between the first linear passage and the second linear passage.

3. The liquid pump device as claimed in claim 2, wherein the cylindrical member comprises: a large diameter part, fit with an inner wall surface of the first linear passage; and the small diameter part, formed in a bottomed shape on a tip side with respect to the large diameter part, arranged with a gap with the inner wall surface of the first linear passage, and the small diameter part is disposed to face the intersection region between the first linear passage and the second linear passage.

4. The liquid pump device as claimed in claim 1, wherein the surrounding wall part has an outer wall surface opposite to the inner wall surface of the first linear passage.

5. The liquid pump device as claimed in claim 4, wherein the surrounding wall part has a plurality of projection parts projecting from the outer wall surface to abut against the inner wall surface of the first linear passage, so as to define a gap between the inner wall surface of the first linear passage and the outer wall surface.

6. The liquid pump device as claimed in claim 1, comprising:

a motor, having a driving shaft rotating around a predetermined axis to rotation-drive the pump unit; and a circuit substrate, to which a control unit controlling driving of the motor is mounted.

7. The liquid pump device as claimed in claim 6, wherein the temperature sensor is connected to the circuit substrate.

8. The liquid pump device as claimed in claim 6, wherein the housing comprises:

a housing body, defining a joining surface joined to an applicable target, a pump accommodation concave part accommodating the pump unit, a motor accommodation concave part accommodating the motor, and the passage; and a pump cover, joined to the housing body so as to cover the pump accommodation concave part, and defining an opening part through which the liquid passes.

9. The liquid pump device as claimed in claim 8, wherein the housing comprises: a through passage extending in parallel with the predetermined axis and penetrating through the housing body to be open to the joining surface, so as to define the first linear passage; and a communication passage, inclined with respect to the axis to extend and allowing the pump accommodation concave part to communicate with the through passage, so as to define the second linear passage, and the temperature sensor is disposed in a manner that the tip region of the temperature sensor faces an intersection region between the through passage and the communication passage.

10. The liquid pump device as claimed in claim 9, wherein the housing comprises a motor cover joined to the housing body, so as to cover the motor accommodation concave part.

11. The liquid pump device as claimed in claim 10, wherein the temperature sensor comprises: a cylindrical member that is bottomed and provided at the motor cover to be inserted into the through passage; and a sensor element, electrically connected to the circuit substrate to be disposed at a tip region inside of the cylindrical member.

12. The liquid pump device as claimed in claim 11, wherein the cylindrical member comprises: a large diameter part, fit with an inner wall surface of the through passage; and the small diameter part, formed in a bottomed shape on a tip side with respect to the large diameter part, arranged with a gap with the inner wall surface of the through passage, and the small diameter part is disposed at the intersection region between the through passage and the communication passage.

13. The liquid pump device as claimed in claim 9, wherein the surrounding wall part has an outer wall surface opposite to the inner wall surface of the through passage.

14. The liquid pump device as claimed in claim 13, wherein the surrounding wall part has a plurality of projection parts projecting from the outer wall surface to abut against the inner wall surface of the through passage, so as to define a gap between the inner wall surface of the through passage and the outer wall surface.

15. The liquid pump device as claimed in claim 10, wherein the housing comprises an outer cover joined to the motor cover to cover the circuit substrate disposed on an outer side of the motor cover.

16. The liquid pump device as claimed in claim 1, wherein the passage on which the temperature sensor is disposed is a discharge passage which discharges liquid pressurized by the pump unit.

17. The liquid pump device as claimed in claim 16, wherein the liquid pump device comprises a filter member disposed upstream of an inlet port sucking the liquid to the pump unit.

18. The liquid pump device as claimed in claim 17, wherein the pump unit is a trochoid-type pump unit comprising an inner rotor and an outer rotor.

* * * * *